US009285121B2

(12) United States Patent
Keener et al.

(10) Patent No.: US 9,285,121 B2
(45) Date of Patent: Mar. 15, 2016

(54) GAS TURBINE COOLING CIRCUIT INCLUDING A SEAL FOR A PERFORATED PLATE

(75) Inventors: Christopher Paul Keener, Woodruff, SC (US); Jason Thurman Stewart, Greer, SC (US); Thomas Edward Johnson, Greer, SC (US); Jonathan Dwight Berry, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 469 days.

(21) Appl. No.: 13/593,123

(22) Filed: Aug. 23, 2012

(65) Prior Publication Data

US 2014/0053571 A1 Feb. 27, 2014

(51) Int. Cl.
*F23R 3/10* (2006.01)
*F23R 3/28* (2006.01)

(52) U.S. Cl.
CPC . *F23R 3/10* (2013.01); *F23R 3/283* (2013.01); *F23R 3/286* (2013.01); *F23R 2900/00012* (2013.01); *F23R 2900/03044* (2013.01)

(58) Field of Classification Search
CPC ..... F23R 3/10; F23R 3/283; F23R 3/286; F23R 2900/03044; F23R 2900/00012; F23D 14/62
USPC ..... 60/725, 799, 800, 747, 756, 754
See application file for complete search history.

(56) References Cited

U.S. PATENT DOCUMENTS 3,552,754 A 1/1971 Bow
3,995,332 A 12/1976 Forchini et al.
4,322,945 A * 4/1982 Peterson et al. ..... 60/800
4,373,580 A 2/1983 Gossalter
4,712,370 A * 12/1987 MacGee ..... 60/785
5,482,296 A 1/1996 Peppiatt et al.
5,987,879 A 11/1999 Ono
6,883,804 B2 4/2005 Cobb
6,962,330 B2 11/2005 Klitsch
7,134,669 B2 11/2006 Uhrner
7,464,940 B2 12/2008 Datta
7,966,832 B1 * 6/2011 Lockyer et al. ..... 60/800
2004/0245729 A1 12/2004 Bock
2009/0072455 A1 3/2009 McPherson
2009/0166984 A1 7/2009 Matsui et al.
2010/0192579 A1 * 8/2010 Boardman et al. ..... 60/737
2010/0207332 A1 8/2010 Smith
2010/0300116 A1 12/2010 Kaleeswaran et al.
2013/0283798 A1 * 10/2013 Bellino ..... F23R 3/286 60/722
2015/0082806 A1 * 3/2015 Willis ..... B23K 1/0018 60/796

* cited by examiner

*Primary Examiner* — William H Rodriguez
*Assistant Examiner* — Thomas Burke
(74) *Attorney, Agent, or Firm* — Nixon & Vanderhye P.C.

(57) ABSTRACT

A cooling circuit of a gas turbine passes an airflow through a combustor section that includes a plurality of mixing tubes for transporting a fuel/air mixture and a perforated plate including a plurality of impingement holes and a plurality of tube holes for accommodating the mixing tubes. The tube holes and the mixing tubes form a plurality of annulus areas between the perforated plate and the mixing tubes. The impingement holes and the annulus areas are configured to pass the airflow through the perforated plate. A flow management device modifies an effective size of the annulus areas to control a distribution of the airflow through the impingement holes and the annulus areas of the perforated plate to enhance cooling efficiency.

23 Claims, 24 Drawing Sheets

GAS TURBINE COOLING CIRCUIT INCLUDING A SEAL FOR A PERFORATED PLATE

FIELD OF THE INVENTION

The present technology relates generally to gas turbines and more particularly to a device for controlling air flow through a perforated plate in a combustor of a gas turbine.

BACKGROUND OF THE INVENTION

Gas turbine engines typically include a compressor for compressing incoming air, a combustor for mixing fuel with the compressed air and igniting the fuel/air mixture to produce a high temperature gas stream, and a turbine section that is driven by the high temperature gas stream. Often, a portion of the incoming air is bled off from the compressor into a cooling circuit for cooling various components of the turbine including a section of the combustor adjacent a reaction zone or combustion chamber.

Cooling efficiency is directly affected by fluid mechanics and distribution of the airflow through the section of the combustor to be cooled. As such, cooling efficiency can be enhanced by more effectively controlling the airflow through the cooling circuit.

BRIEF SUMMARY OF THE INVENTION

One exemplary but nonlimiting aspect of the disclosed technology relates to a method of controlling a flow rate and/or a distribution of a cooling airflow through a perforated plate of a gas turbine to affect cooling efficiency.

Another exemplary but nonlimiting aspect of the disclosed technology relates to a flow management device situated near an annulus area formed between a mixing tube and a perforated plate to control the flow rate of airflow through the annulus area.

In one exemplary but nonlimiting embodiment, there is provided a gas turbine including a plurality of mixing tubes arranged to transport at least one of fuel and air to a reaction zone for ignition. A perforated plate has a plurality of impingement holes and a plurality of tube holes formed therein, the tube holes being configured to accommodate the mixing tubes thereby forming a plurality of annulus areas between the perforated plate and the mixing tubes, wherein the impingement holes and the annulus areas are configured to pass an airflow through the perforated plate. A flow management device engages at least one of the perforated plate and the mixing tubes and includes a portion situated near the annulus areas to control a distribution of the airflow through the impingement holes and the annulus areas of the perforated plate.

In another exemplary but nonlimiting embodiment, there is provided a method of controlling airflow through a perforated plate in a gas turbine, the perforated plate including a plurality of impingement holes and a plurality of tube holes formed therein, the tube holes being adapted to accommodate a plurality of mixing tubes with which the tube holes form a plurality of annulus areas, the method comprising steps of 1) establishing an airflow adapted to pass through the impingement holes and the annulus areas; and 2) adjusting an effective size of the annulus areas to control a distribution of the airflow through the impingement holes and the annulus areas of the perforated plate.

In still another exemplary but nonlimiting embodiment, there is provided a cooling air circuit positioned near a reaction zone in a gas turbine and including an inlet through which an airflow enters a section of the gas turbine. A perforated plate is situated in the section and includes a plurality of holes formed therein to pass the airflow through the perforated plate. A plurality of mixing tubes extends through a first portion of the plurality of holes to transport at least one of fuel and air to the reaction zone for ignition, wherein the first portion of holes forms a plurality of annulus areas between the perforated plate and the mixing tubes. A flow management device engages at least one of the perforated plate and the mixing tubes and controls a flow rate of the airflow through the first portion of holes.

BRIEF DESCRIPTION OF THE DRAWINGS

The accompanying drawings facilitate an understanding of the various examples of this technology. In such drawings.

DETAILED DESCRIPTION OF THE ILLUSTRATED EMBODIMENTS

Figure 1:
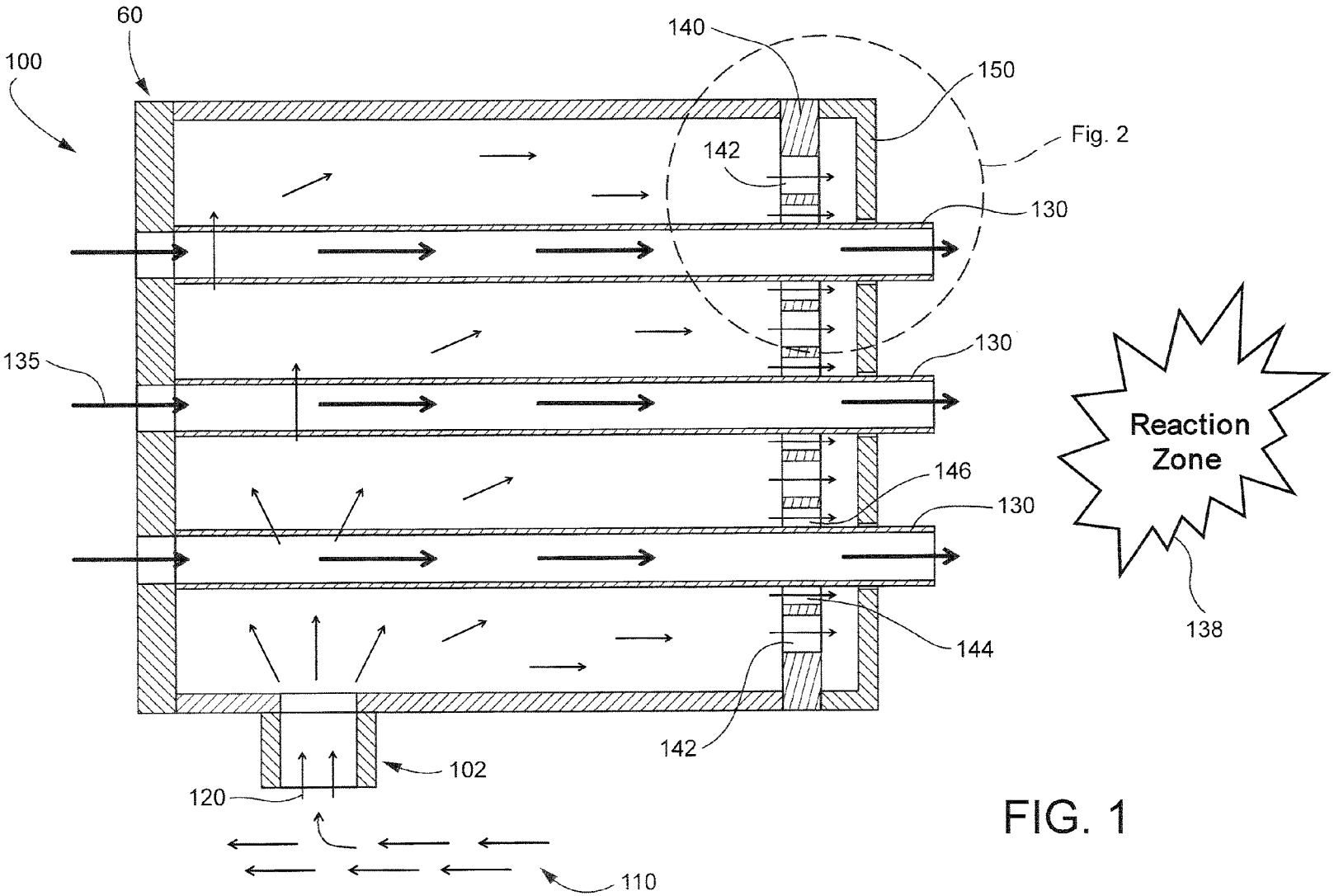
FIG. 1 shows a schematic representation of a combustor cooling circuit including a perforated plate in a gas turbine according to an example of the disclosed technology.
Figure 2:
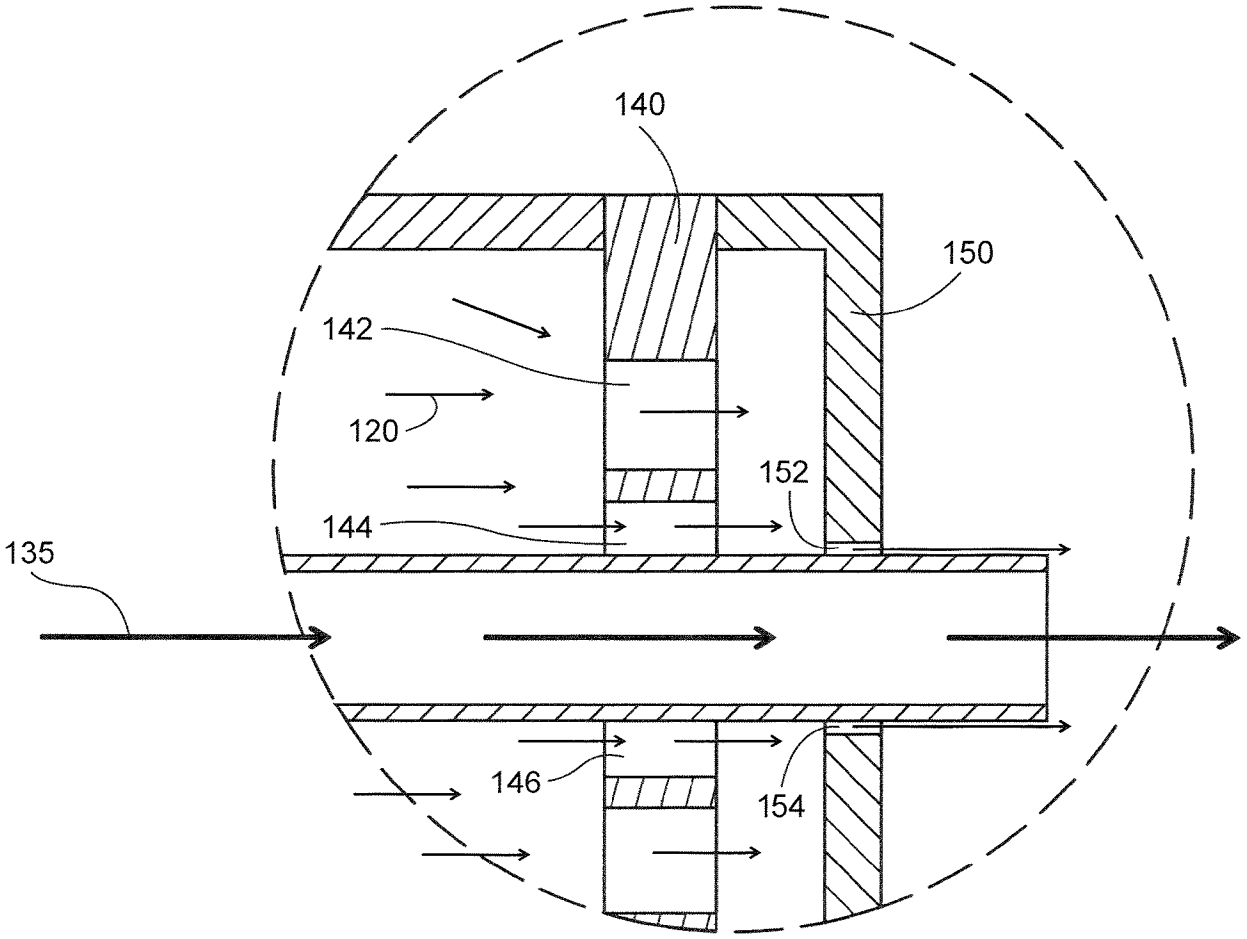
FIG. 2 is an enlarged detail taken from FIG. 1.

Referring to FIGS. 1 and 2, a downstream section 60 of a combustor is situated near a reaction zone 138 or combustion chamber where fuel is ignited to create mechanical energy. A hot plate 150 functions as a barrier between the combustor section 60 and the reaction zone 138.

A plurality of mixing tubes 130 extend through the combustor section 60 to transport a fuel/air mixture 135 to the reaction zone 138 for ignition. An incoming airflow 110 flows to an upstream area (not shown) of the gas turbine where it mixes with fuel to form the fuel/air mixture 135 and is then transported to the reaction zone via the mixing tubes 130. A portion of the incoming airflow 110 is bled off into a cooling circuit 100 to cool the hot plate 150. A circuit airflow 120 enters the circuit 100 via an inlet 102 and flows towards the reaction zone 138.

A perforated plate 140 is situated in the combustor section 60 near the hot plate 150. The perforated plate 140 includes a plurality of tube holes 144 for accommodating the mixing tubes 130 and a plurality of impingement holes 142 for passing the circuit airflow 120 through the perforated plate 140 to cool the hot plate 150. The tube holes 144 are formed large enough such that the mixing tubes 130 do not contact the perforated plate 140. This arrangement minimizes wear to the perforated plate and the mixing tubes and further avoids damage that may be caused by sudden movement of the perforated plate or mixing tubes. The impingement holes 142 are shown in FIGS. 1 and 2 in a relatively large scale for ease of understanding. In fact, a more accurate depiction of the relative size of the impingement holes 142 and the tube holes 144 is shown in FIG. 3.

The tube holes 144 and the mixing tubes 130 form annulus areas 146 between the perforated plate 140 and the mixing tubes. As the size of the annulus areas increases, however, effectiveness of cooling is reduced due to poor air flow distribution through the perforated plated 140 as a consequence of increased flow passing through the annulus areas 146.

The hot plate 150 includes holes 152 formed therein for accommodating the mixing tubes 130, as shown in FIG. 2. The holes 152 are sized large enough to form gaps 154 between the hot plate 150 and the mixing tubes 130. As shown in FIG. 2, the circuit airflow 120 exits the cooling air circuit 100 through the gaps 154.

Figure 3:
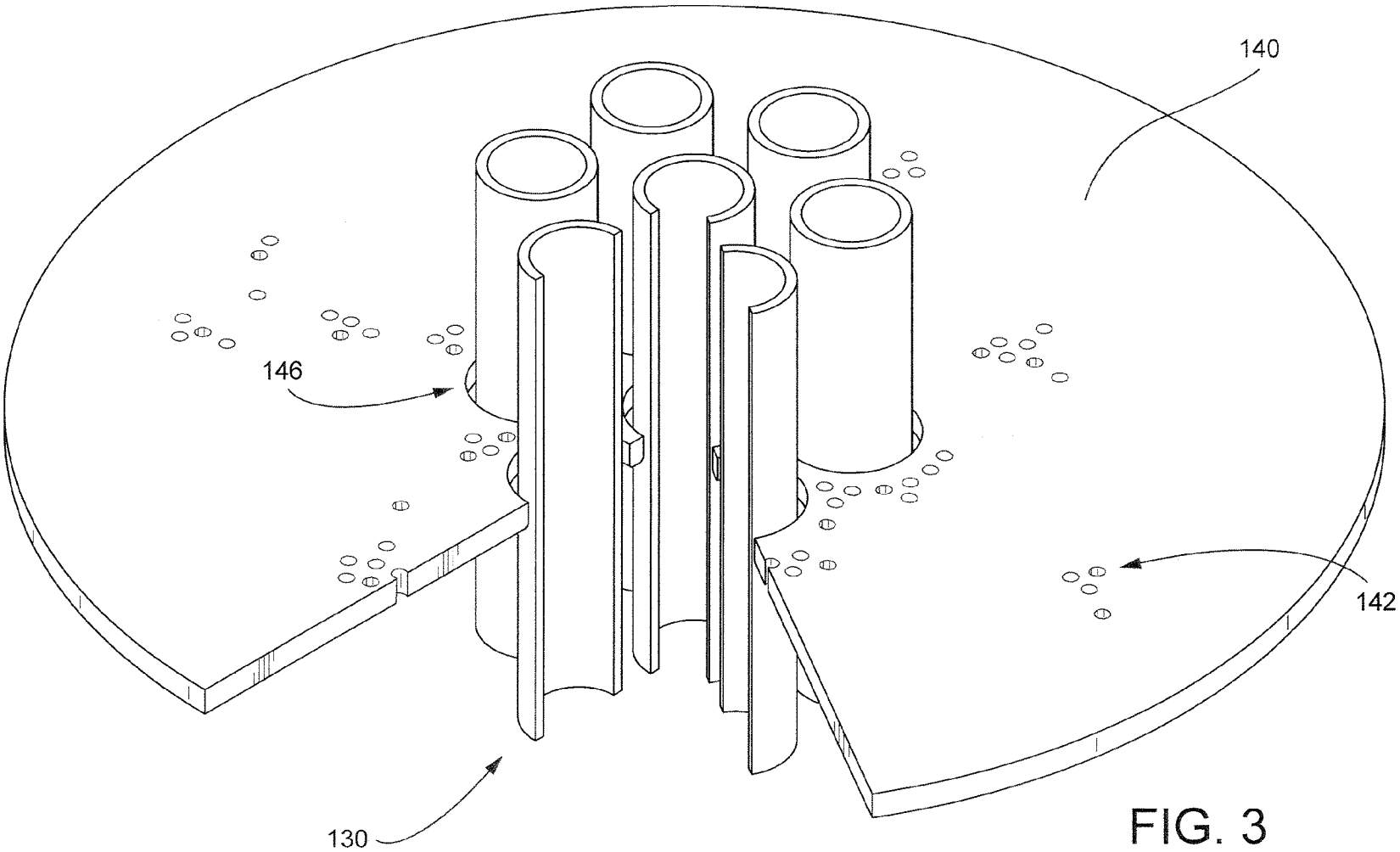
FIG. 3 is a perspective view of a perforated plate and a plurality of mixing tubes according to an earlier configuration known to applicants.
Figure 4:
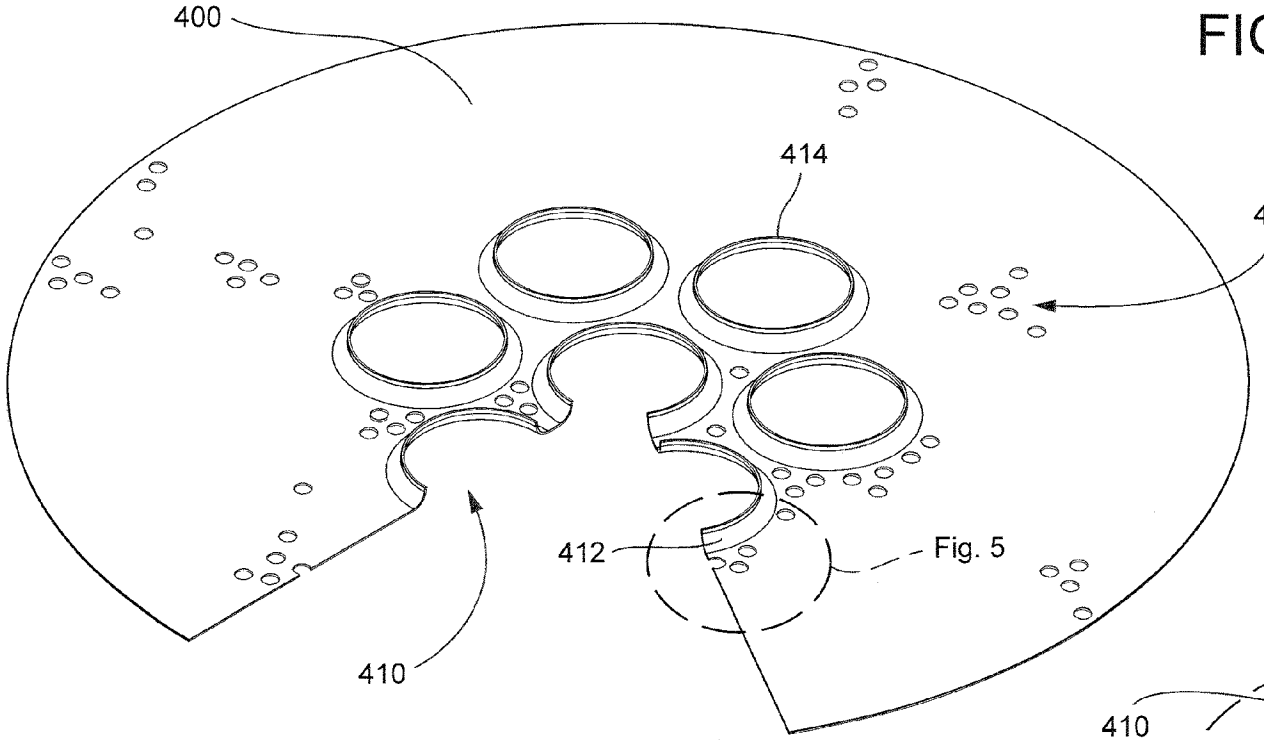
FIG. 4 is a perspective view of a sealing plate according to a first example of the disclosed technology.
Figure 5:
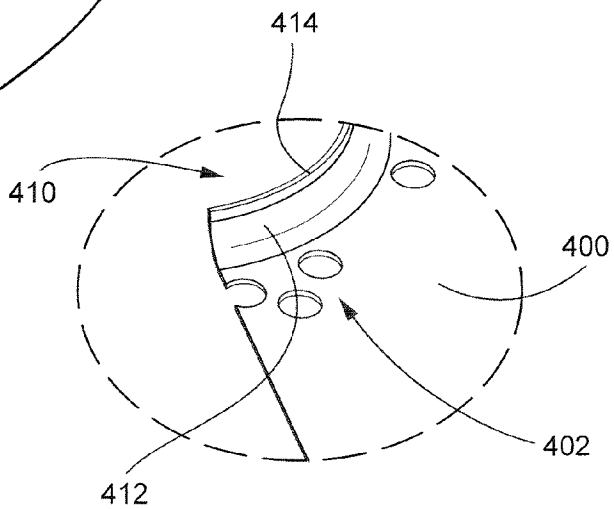
FIG. 5 is an enlarged detail taken from FIG. 4.
Figure 6:
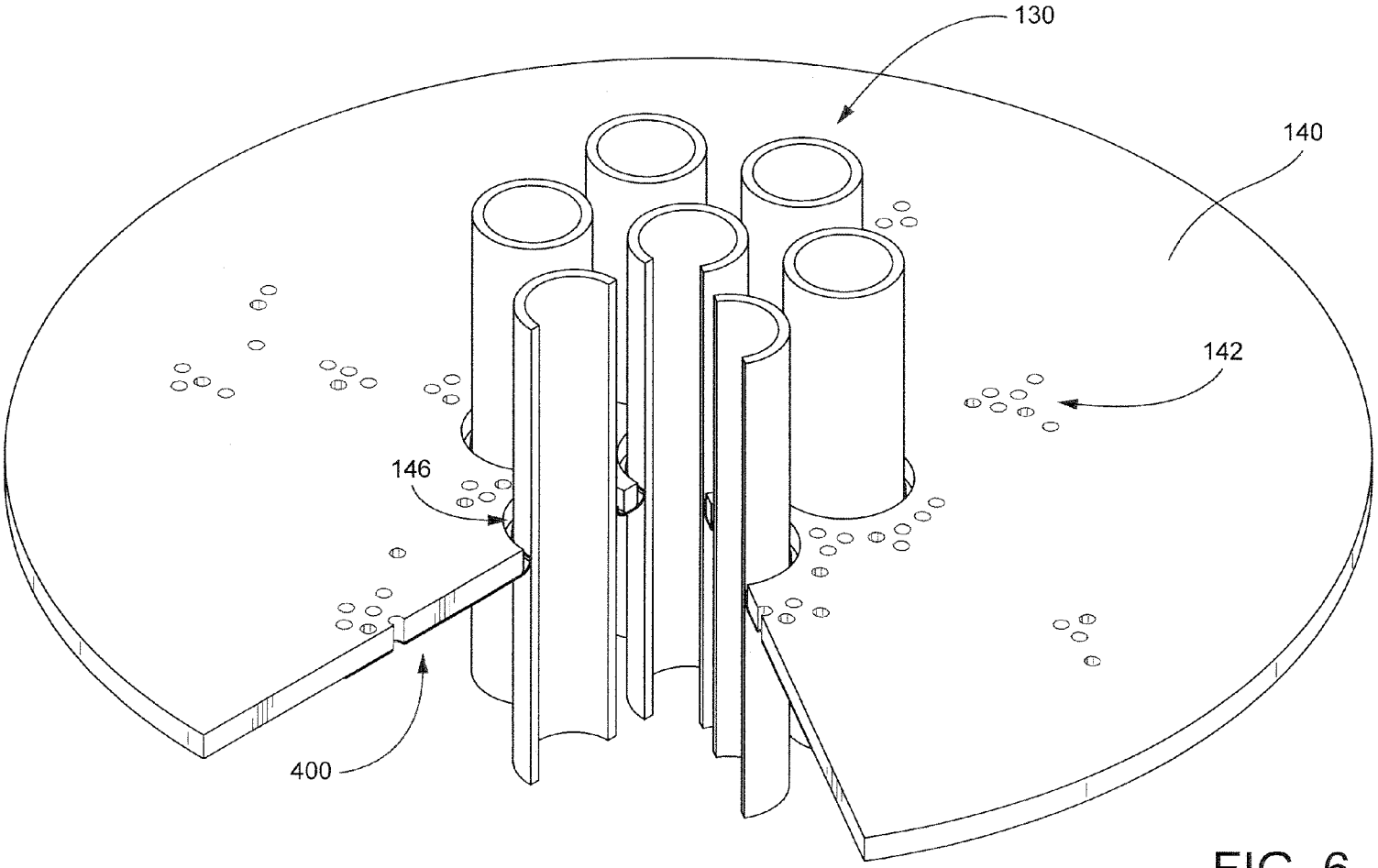
FIG. 6 is a perspective view of a perforated plate assembly including the sealing plate of FIGS. 4 and 5.
Figure 7:
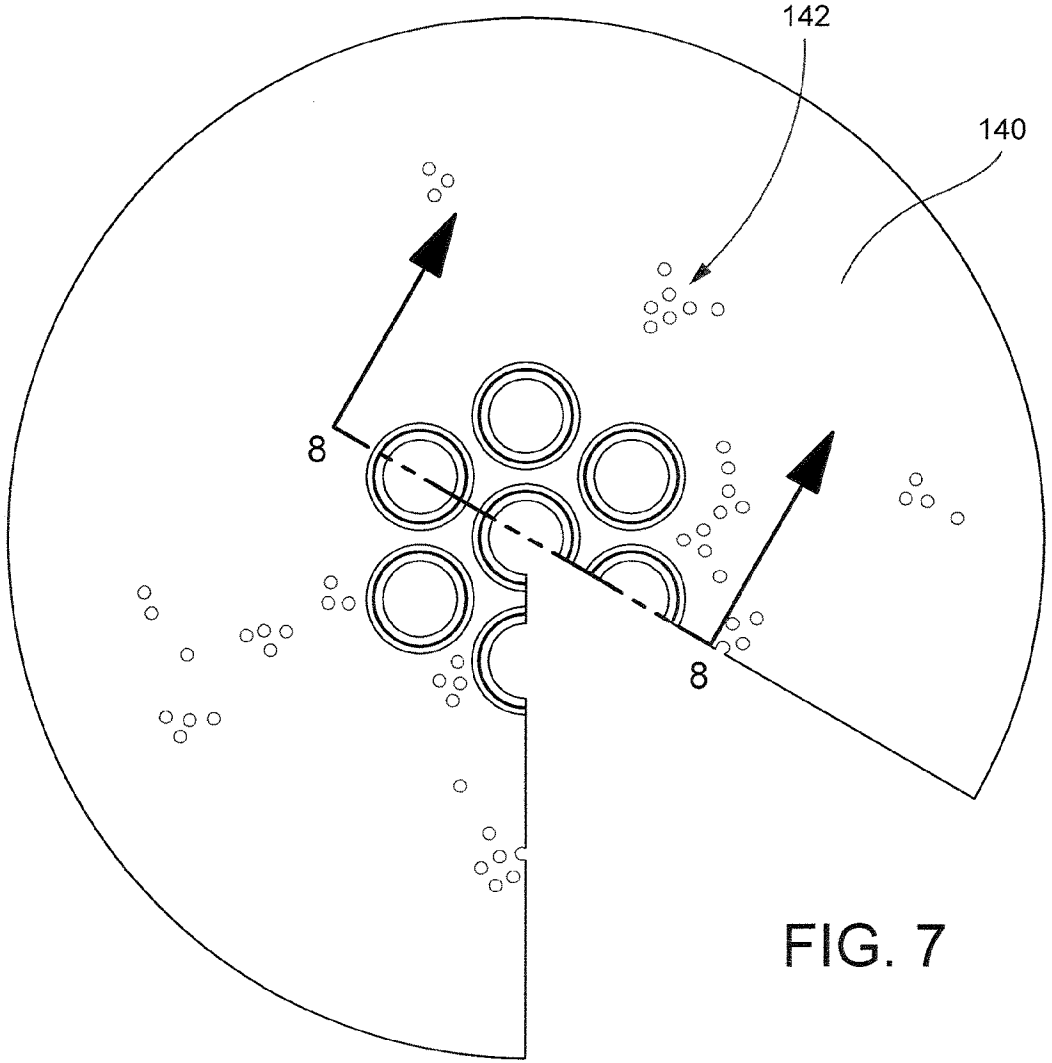
FIG. 7 is a top view of the perforated plate assembly of FIG. 6.
Figure 8:
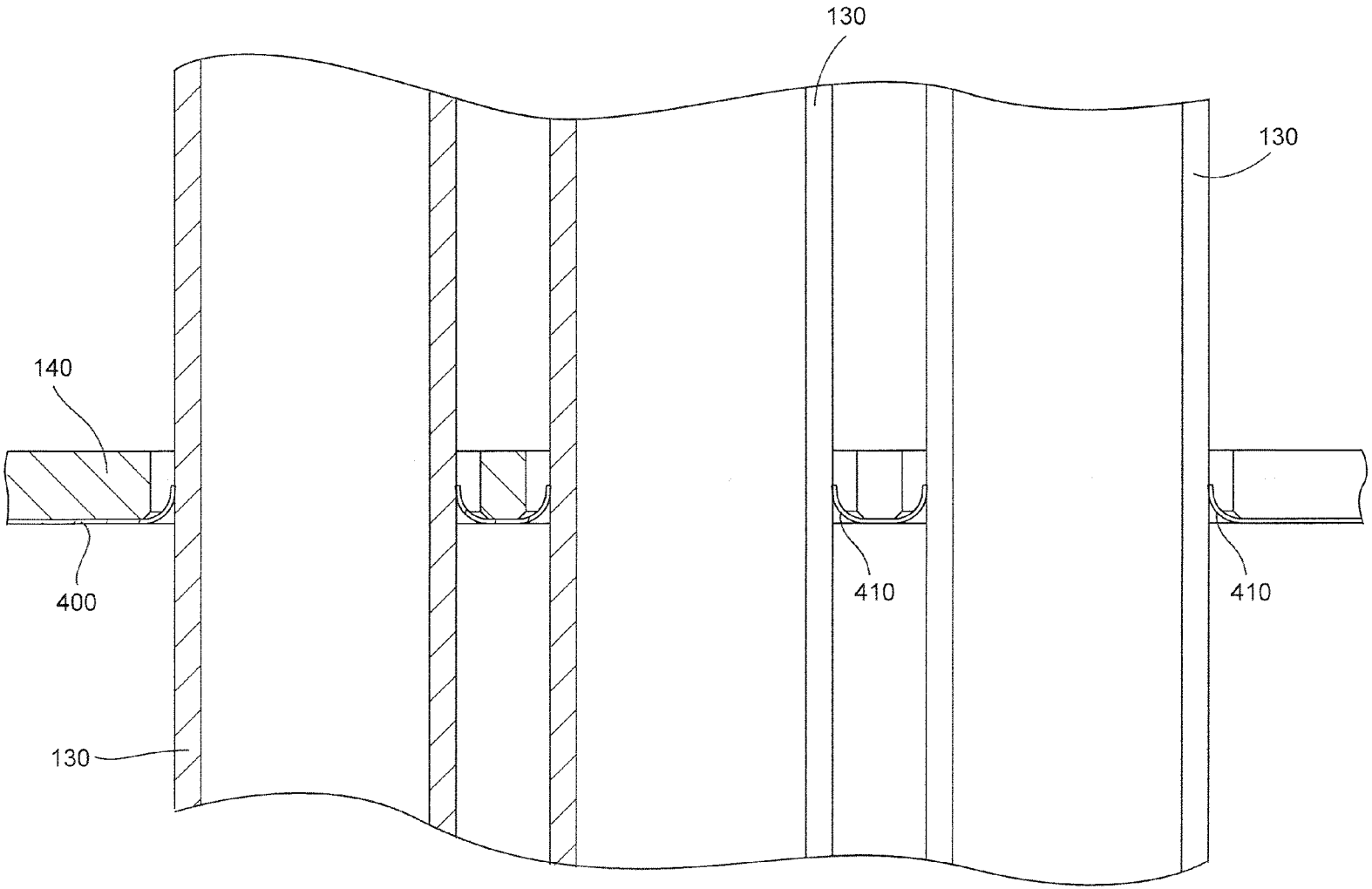
FIG. 8 is a cross-sectional view along the line 8-8 of FIG. 7.
Figure 9:
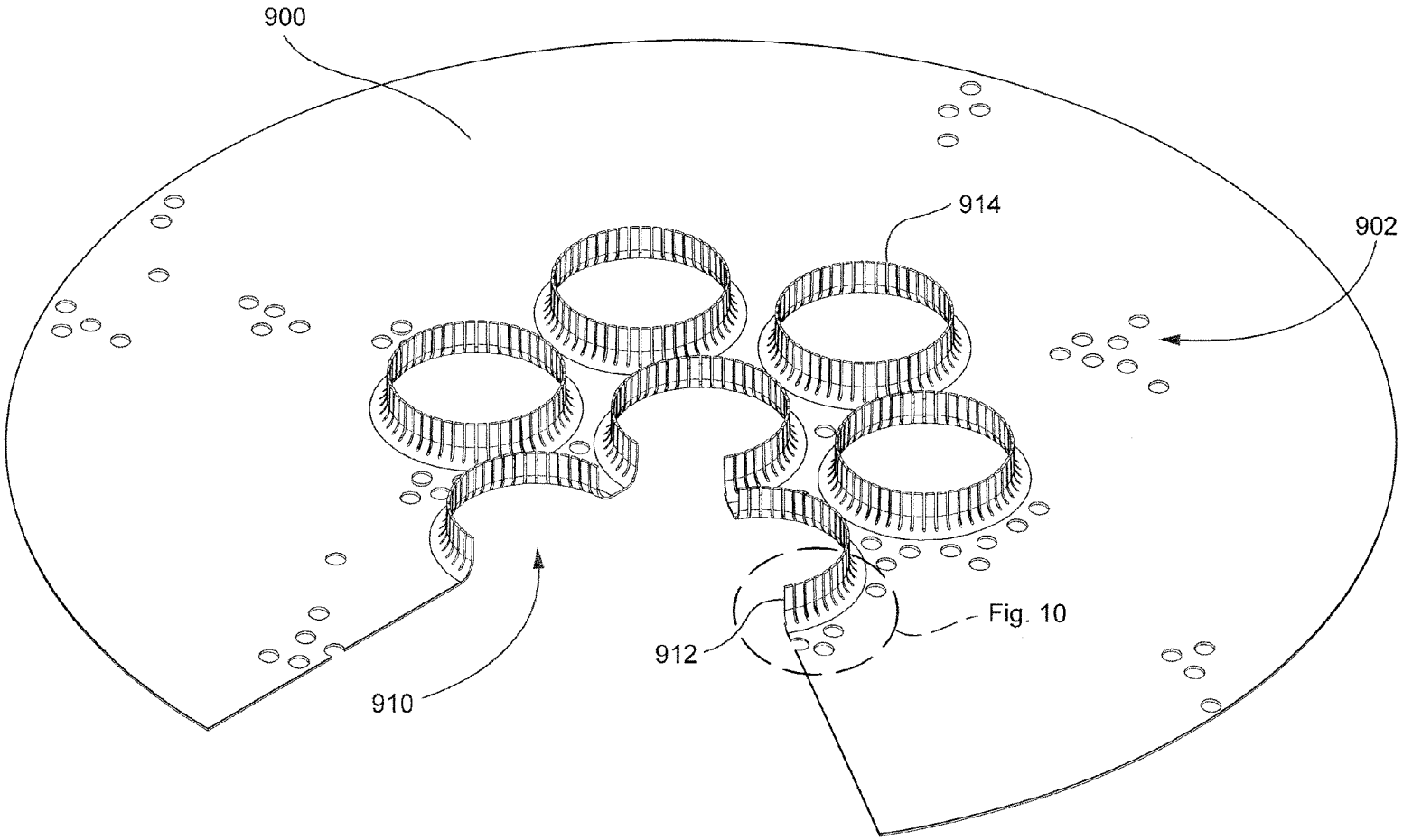
FIG. 9 is a perspective view of a metering plate according to a second example of the disclosed technology.

In FIG. 3, it is seen that the impingement holes 142 are interspersed on the perforated plate 140 among the tube holes 144. It is noted that the impingement holes 142 may be arranged on the perforated plate in any suitable manner. For illustration purposes, the tube holes 144 (and mixing tubes 130) are only shown in a central portion of the perforated plate; however, the tube holes may occupy a smaller or larger portion of the perforated plate and further may be arranged in any suitable manner on the perforated plate.

Turning to FIGS. 4-8, a sealing plate 400 for controlling air flow through the annulus areas 146 is shown in accordance with an example of the disclosed technology. The sealing plate is formed of a thin metal sheet and is attached to an upstream side of the perforated plate 140. It is noted, however, that one skilled in the art will understand that the sealing plate may be configured for attachment to a downstream side of the perforated plate. The sealing plate 400 includes a plurality of sealing elements 410 formed as holes in the sealing plate corresponding to at least a portion of the tube holes 144 and sized to contact the mixing tubes 130 within the annulus areas 146. The sealing plate also includes features, such as a plurality of through holes 402 which allow the circuit airflow 120 to pass through the impingement holes 142.

The sealing plate 400 may be integrally attached to the perforated plate 140 or tubes 130 by welding or brazing. The sealing plate 400 may also be attached mechanically with bolted fasteners or rivets. However, the sealing plate can be constrained by the pressure loading across the plate and the compression force of the sealing elements 410 (or fingers described below) against the tube walls.

The sealing elements 410 affect the circuit airflow 120 passing through the annulus areas 146 (see FIGS. 1 and 2 along with FIG. 6) while also dampening vibration of the mixing tubes. The sealing elements 410 are configured to seal against the mixing tubes 130 to prevent the cooling airflow 120 from passing through the annulus areas 146. The sealing elements include an angled portion 412 extending at an incline to the sealing plate and an engaging portion 414 connected to the angled portion. The engaging portion 414 extends at an incline to the angled portion 412 and engages the mixing tubes 130 to form a seal. The respective sizes and orientations of the angled portion 412 and the engaging portion 414 may be modified to adjust the seal with the mixing tubes. By sealing the annulus areas 146 and restoring total flow of the circuit airflow 120 to the impingement holes 142, a more even distribution of the circuit airflow through the perforated plate 140 may be achieved. A more uniform flow through the perforated plate may enhance cooling efficiency. It will be appreciated that a negligible level of leakage may be observed at the annulus areas 146. Furthermore, the sealing elements 410 may actually be configured to provide a desired level of leakage.

As discussed above, the sealing elements 410 contact the mixing tubes 130. The sealing elements 410 (and the fingers and thimbles described below) may be made of spring steel or other suitable materials, such as Standard 300/400 series stainless steels and nickel alloys. This arrangement effectively causes the sealing elements 410 to dampen vibration of the mixing tubes 130. The sizes and orientations of the angled portion 412 and the engaging portion 414 can also be adjusted to increase or decrease the contact area with the mixing tubes 130 to adjust the level of dampening. The sealing elements are also compliant so as to accommodate for movement and misalignment of the mixing tubes 130.

Instead of sealing the annulus areas 146, a sealing plate may be configured to meter airflow through the annulus areas, thereby distributing the circuit airflow 120 between the impingement holes 142 and the annulus areas 146 as desired. Referring to FIGS. 9-13, a metering plate 900 is shown in accordance with another example of the disclosed technology. The metering plate includes features such as a plurality of through holes 902 corresponding to the impingement holes 142 of the perforated plate 140. In contrast to the sealing plate 400 described above, the metering plate 900 includes a plurality of metering elements 910 comprised of fingers 912 separated by spaces 914. The respective sizes of the fingers 912 and spaces 914 can be adjusted to achieve a desired level of metering, stiffness, and/or contact area with the mixing tubes 130.

Figure 10:
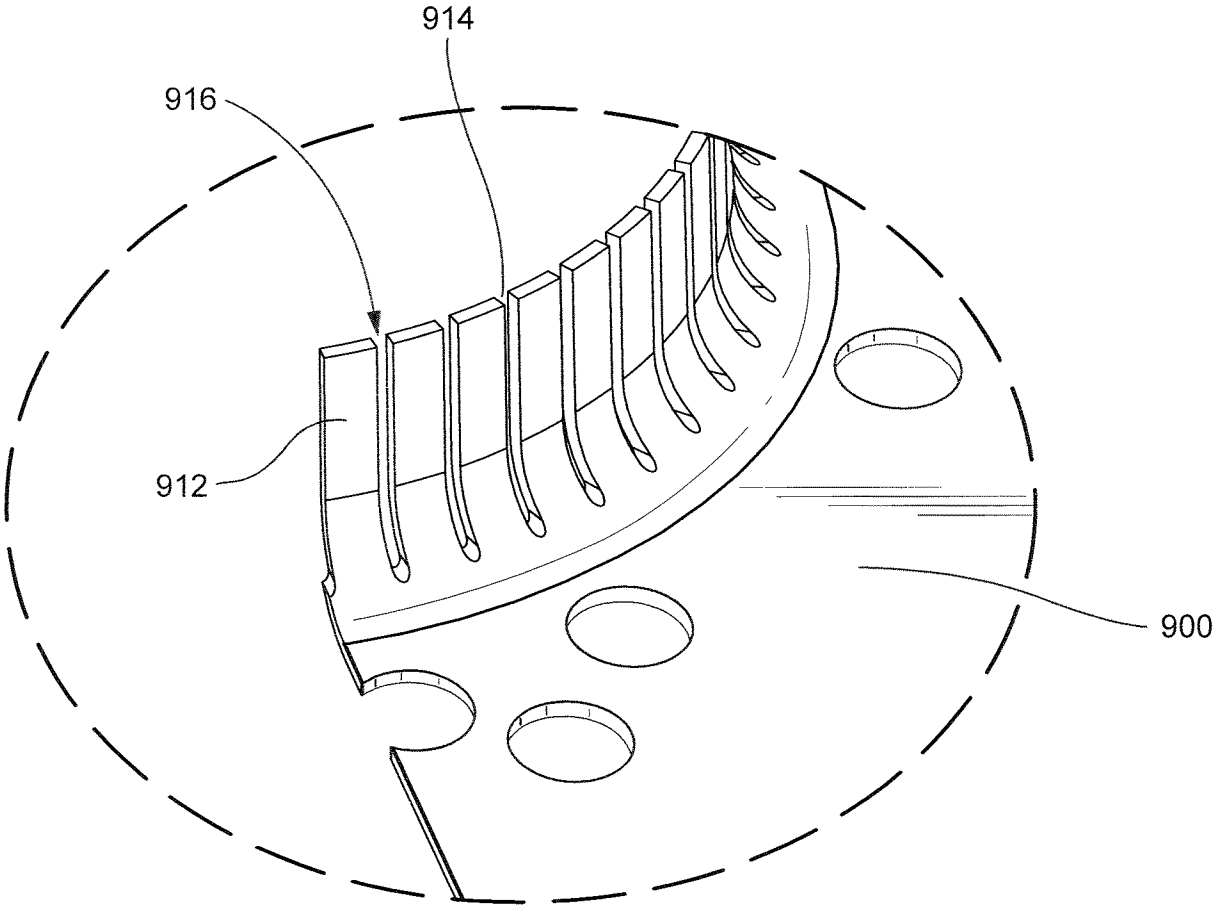
FIG. 10 is an enlarged detail taken from FIG. 9.
Figure 11:
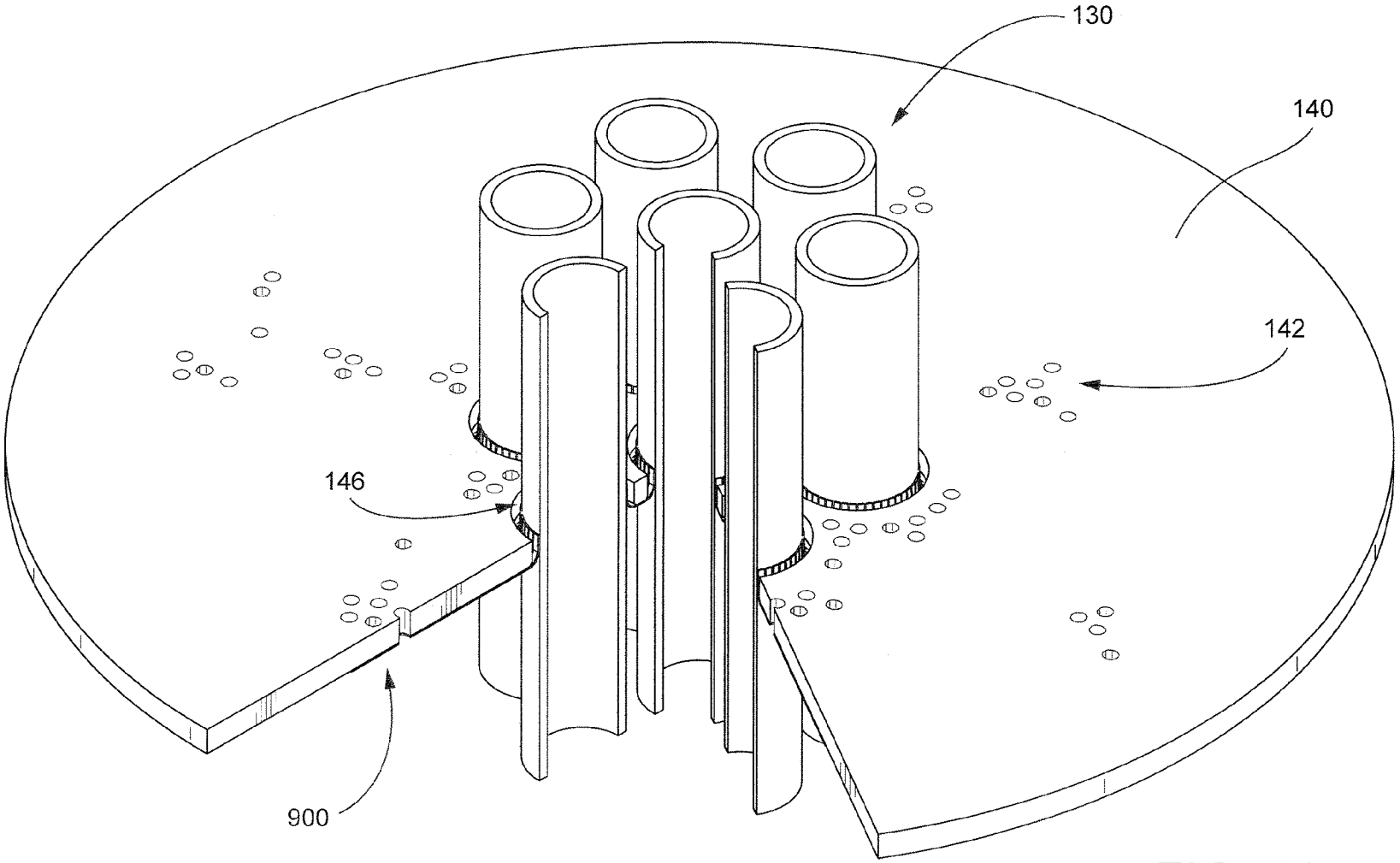
FIG. 11 is a perspective view of a perforated plate assembly including the metering plate of FIGS. 9 and 10.
Figure 12:
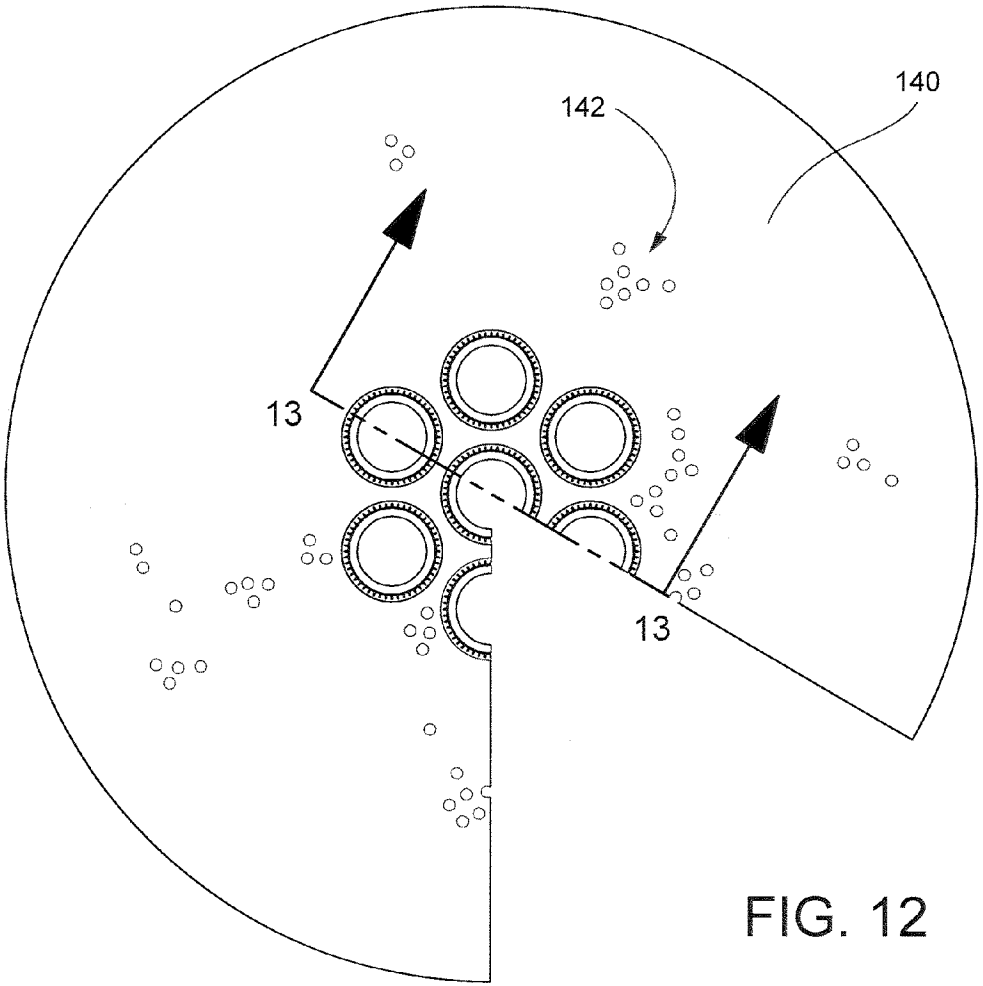
FIG. 12 is a top view of the perforated plate assembly of FIG. 11.
Figure 13:
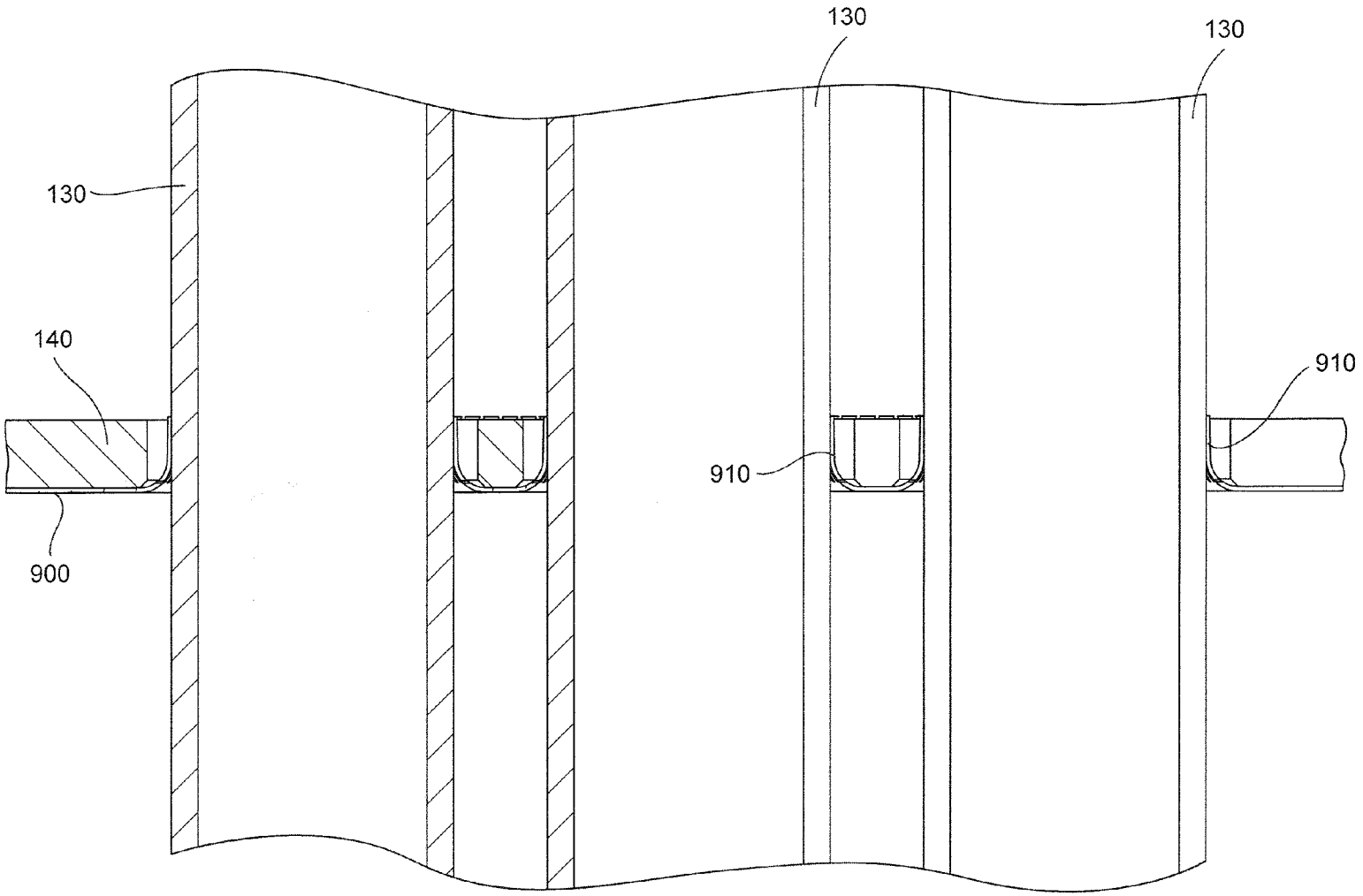
FIG. 13 is a cross-sectional view along the line 13-13 of FIG. 12.
Figure 14:
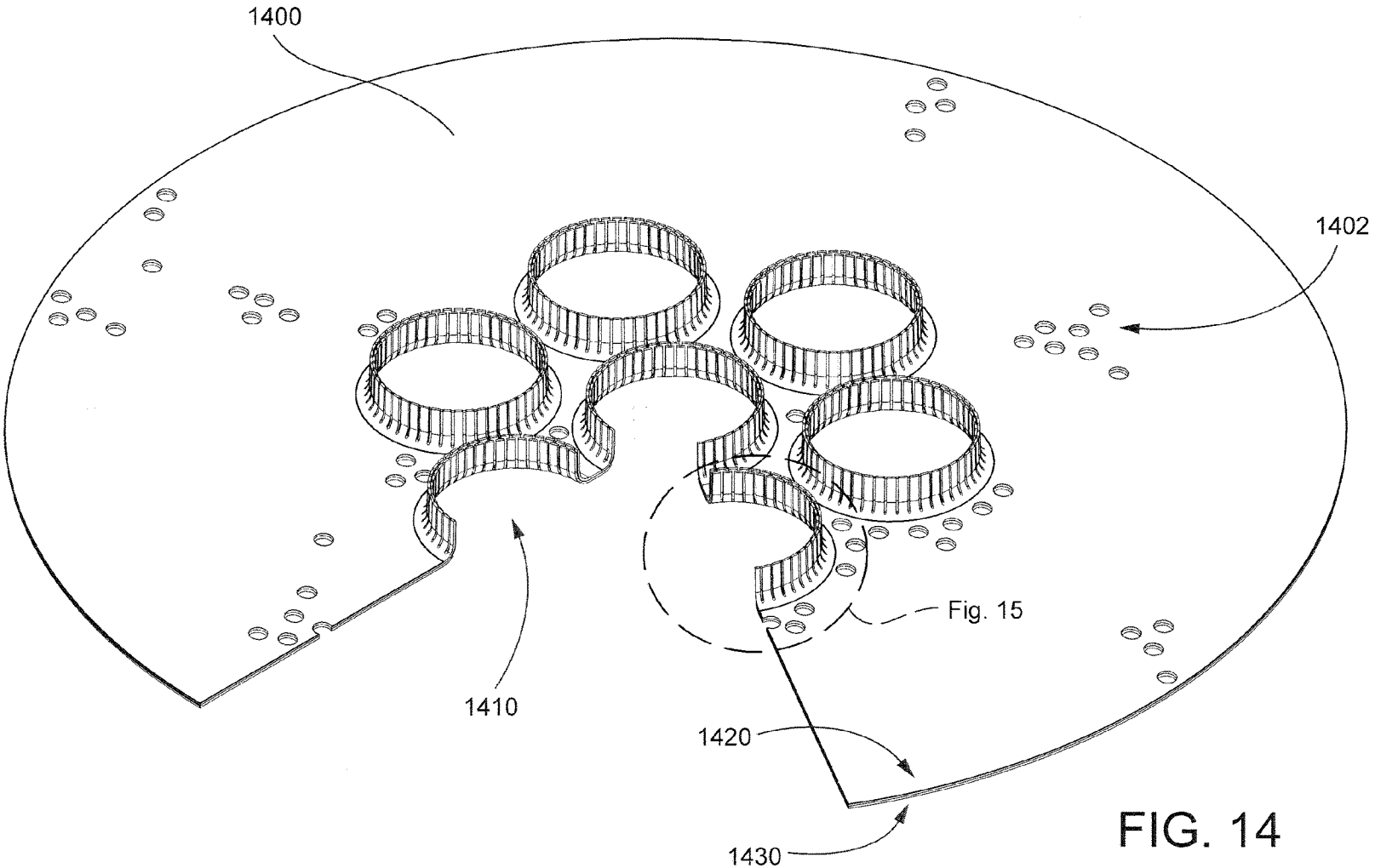
FIG. 14 is a perspective view of a two-ply metering plate according to a third example of the disclosed technology.
Figure 15:
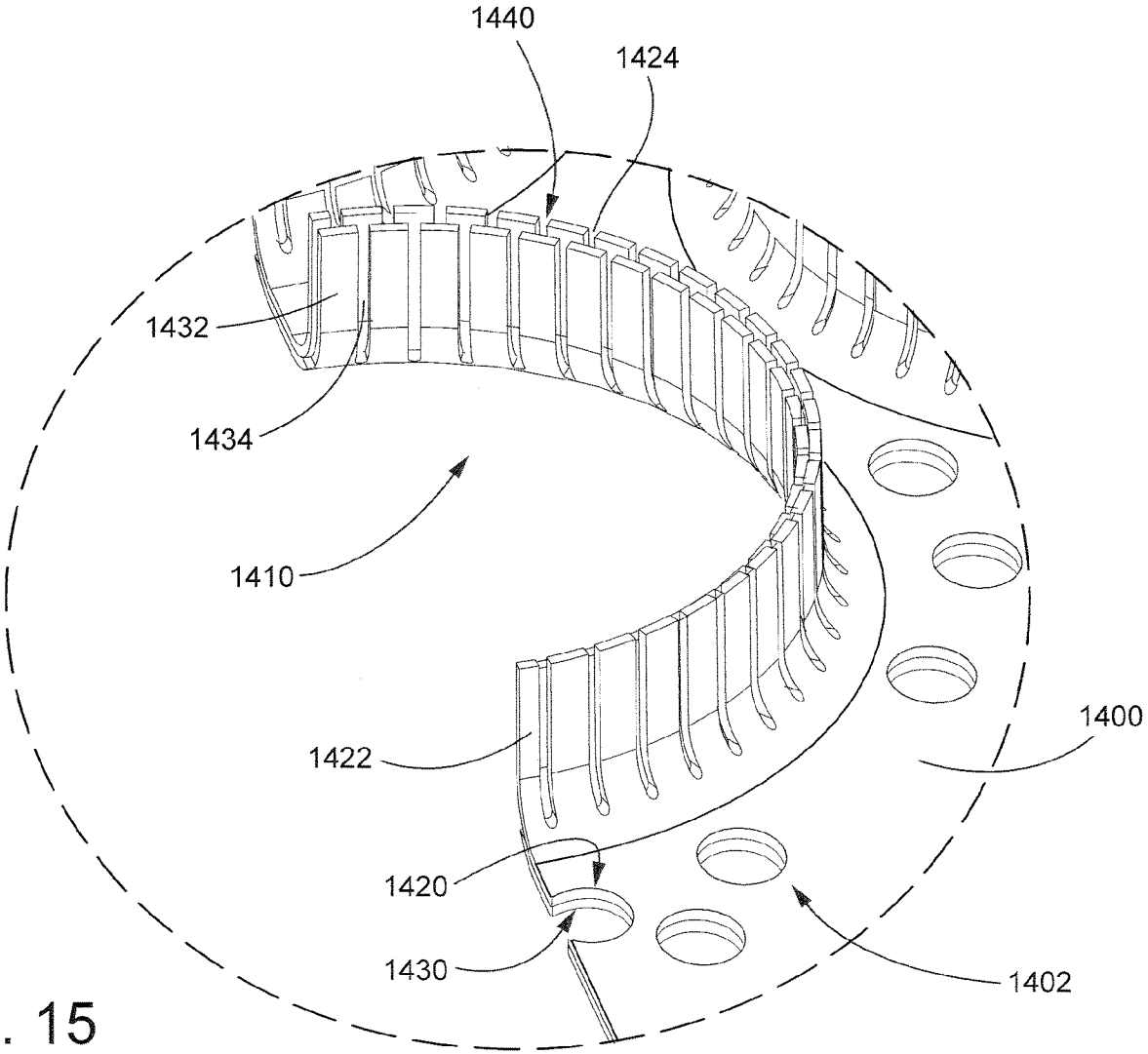
FIG. 15 is an enlarged detail taken from FIG. 14.
Figure 16:
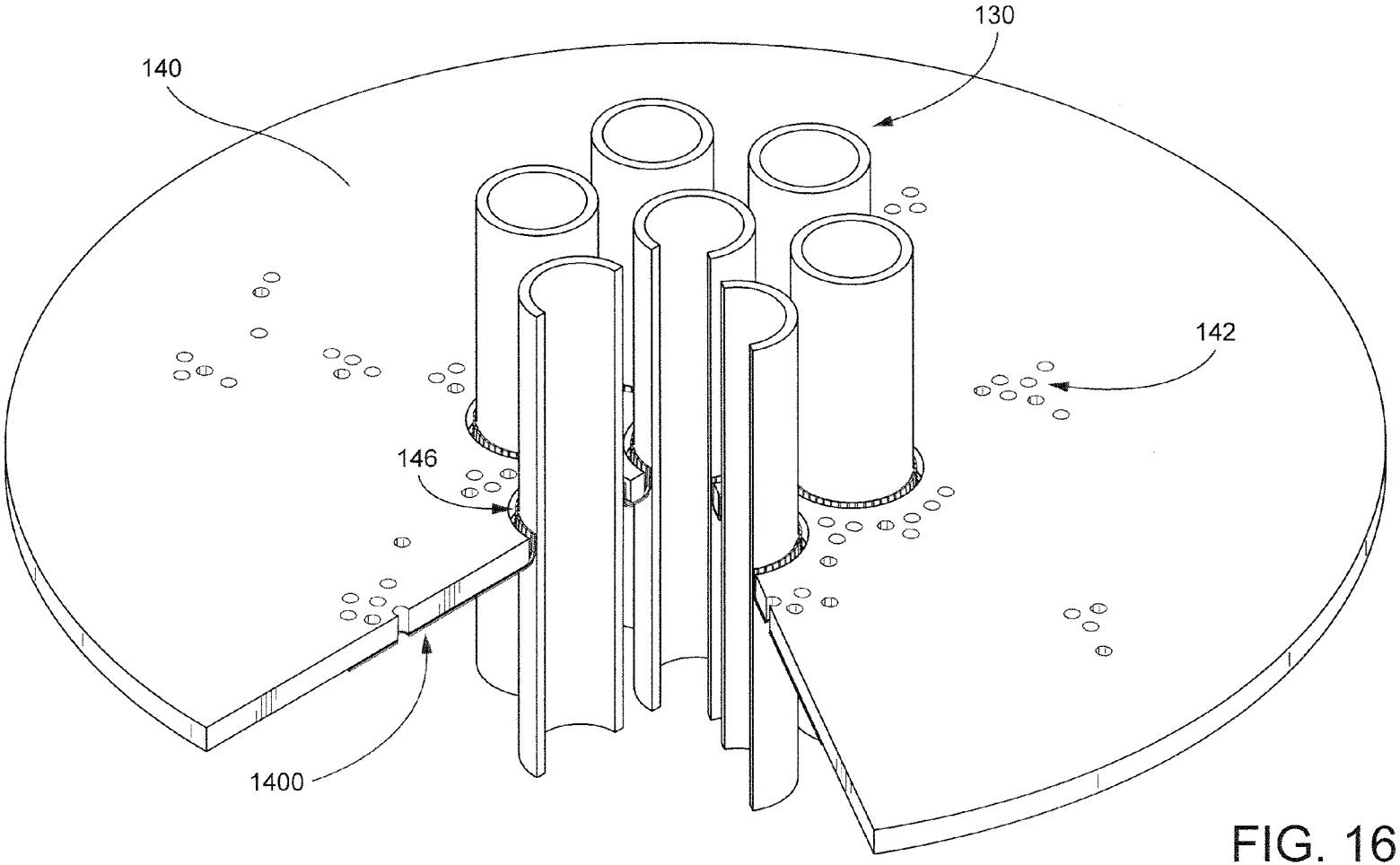
FIG. 16 is a perspective view of a perforated plate assembly including the two-ply metering plate of FIGS. 14 and 15.
Figure 17:
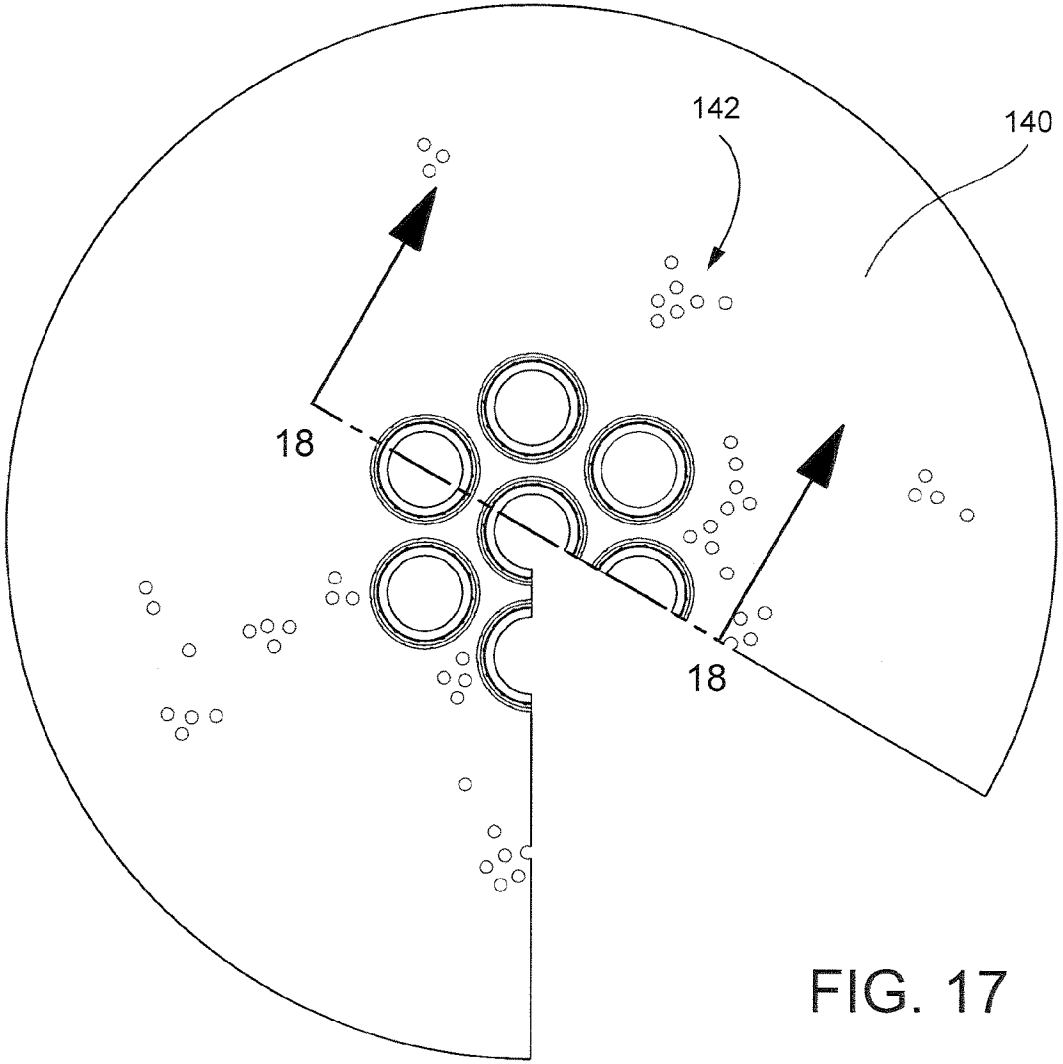
FIG. 17 is a top view of the perforated plate assembly of FIG. 16.
Figure 18:
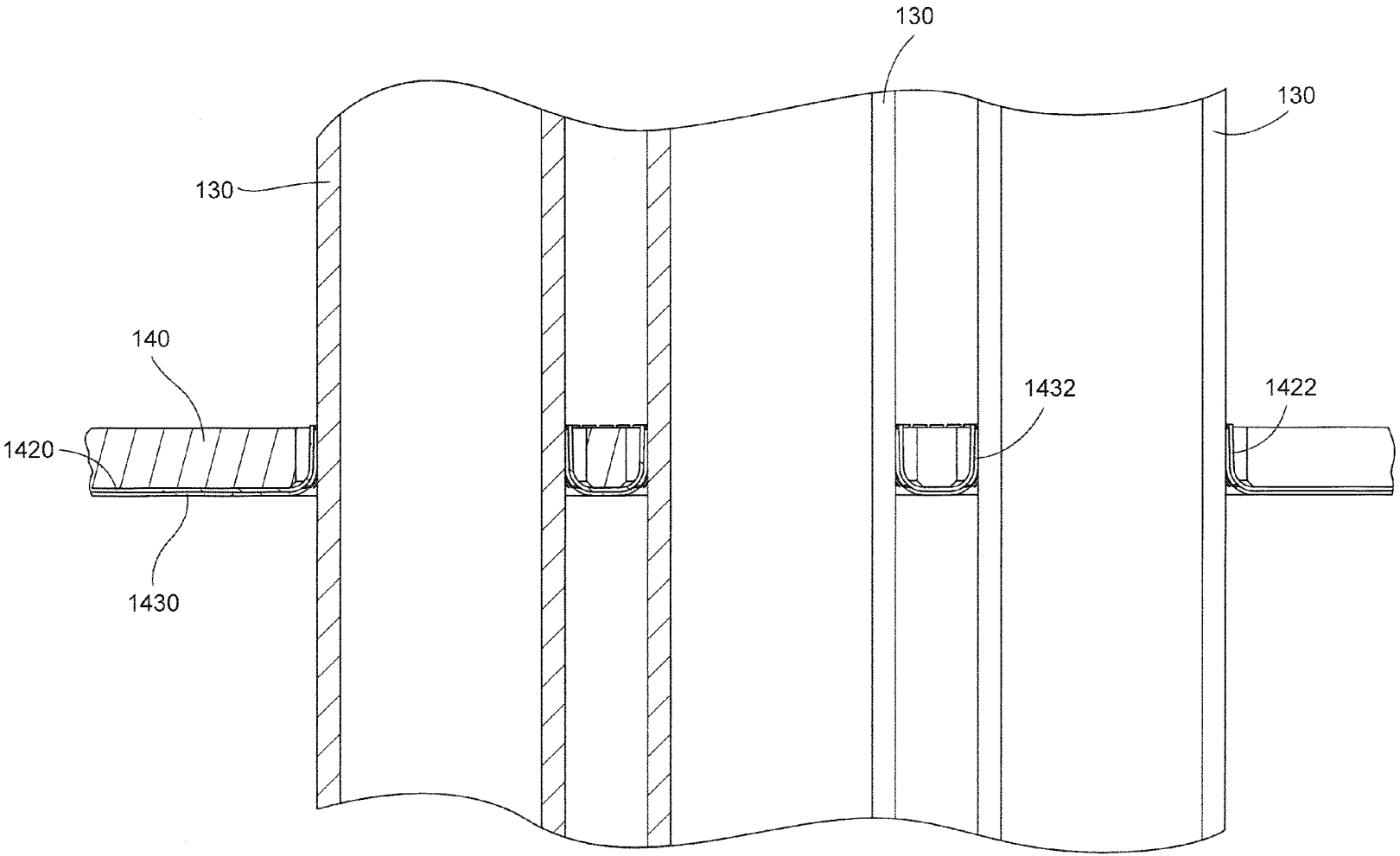
FIG. 18 is a cross-sectional view along the line 18-18 of FIG. 17.
Figure 19:
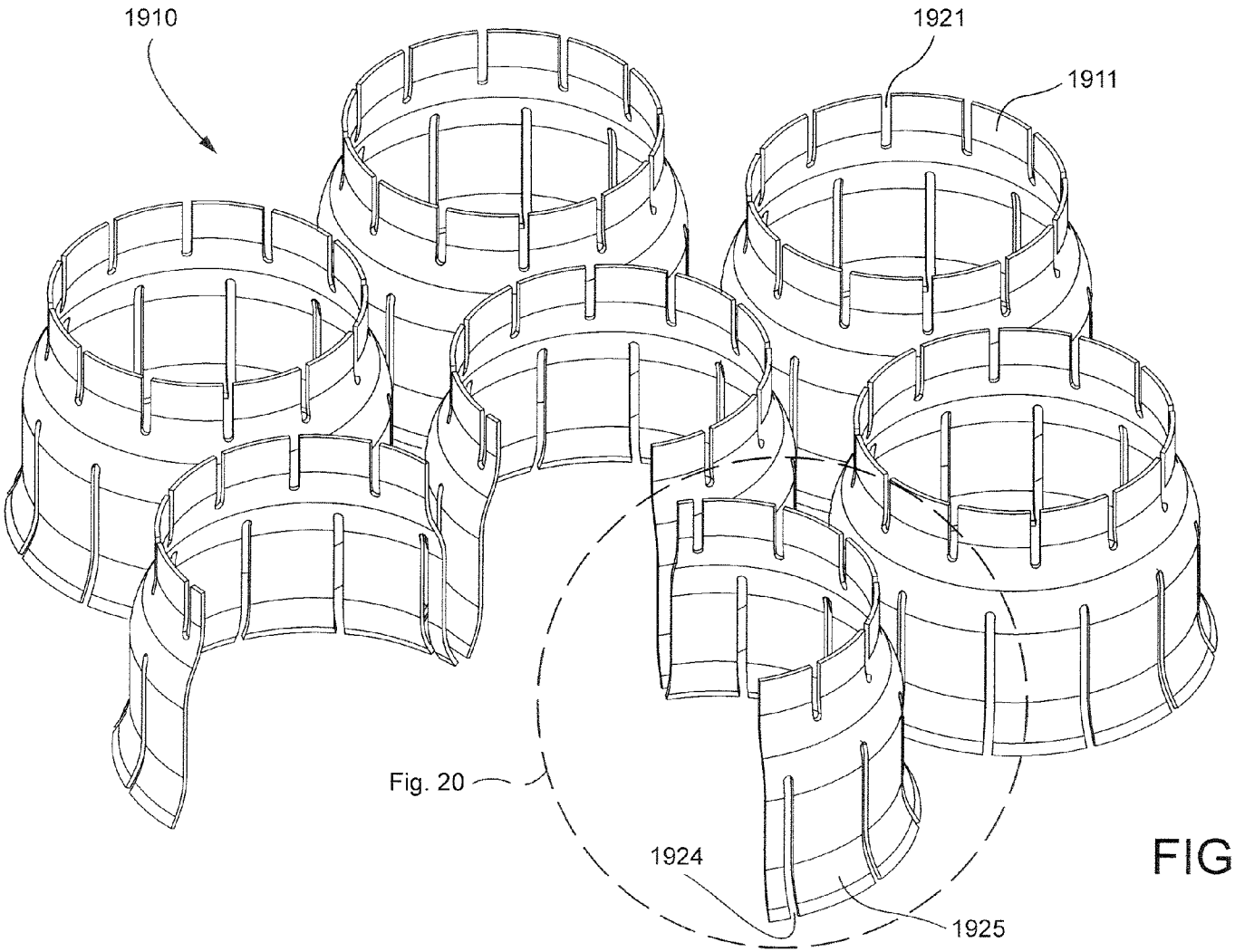
FIG. 19 is a perspective view of individual metering thimbles according to a fourth example of the disclosed technology.
Figure 20:
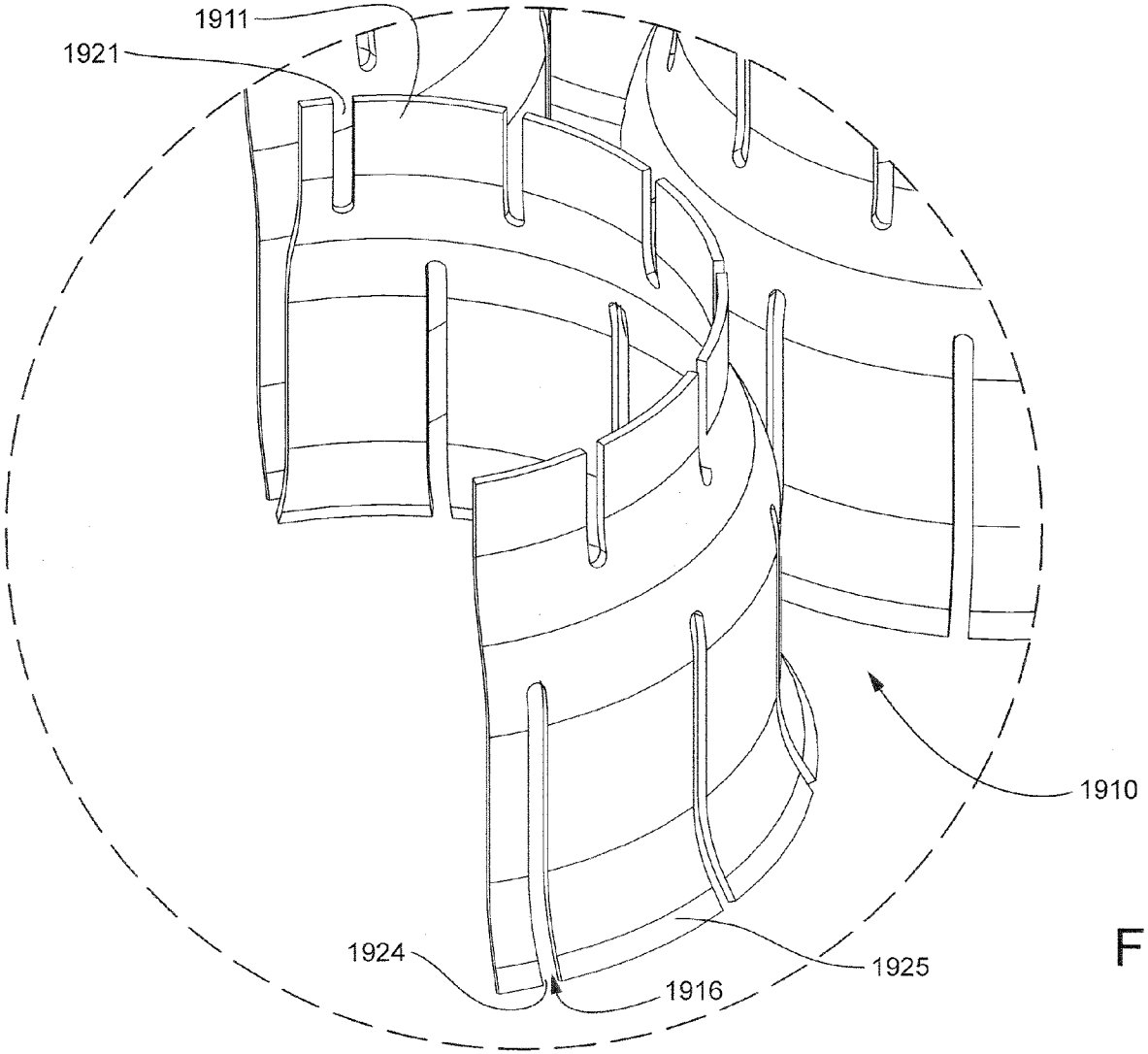
FIG. 20 is an enlarged detail taken from FIG. 19.
Figure 21:
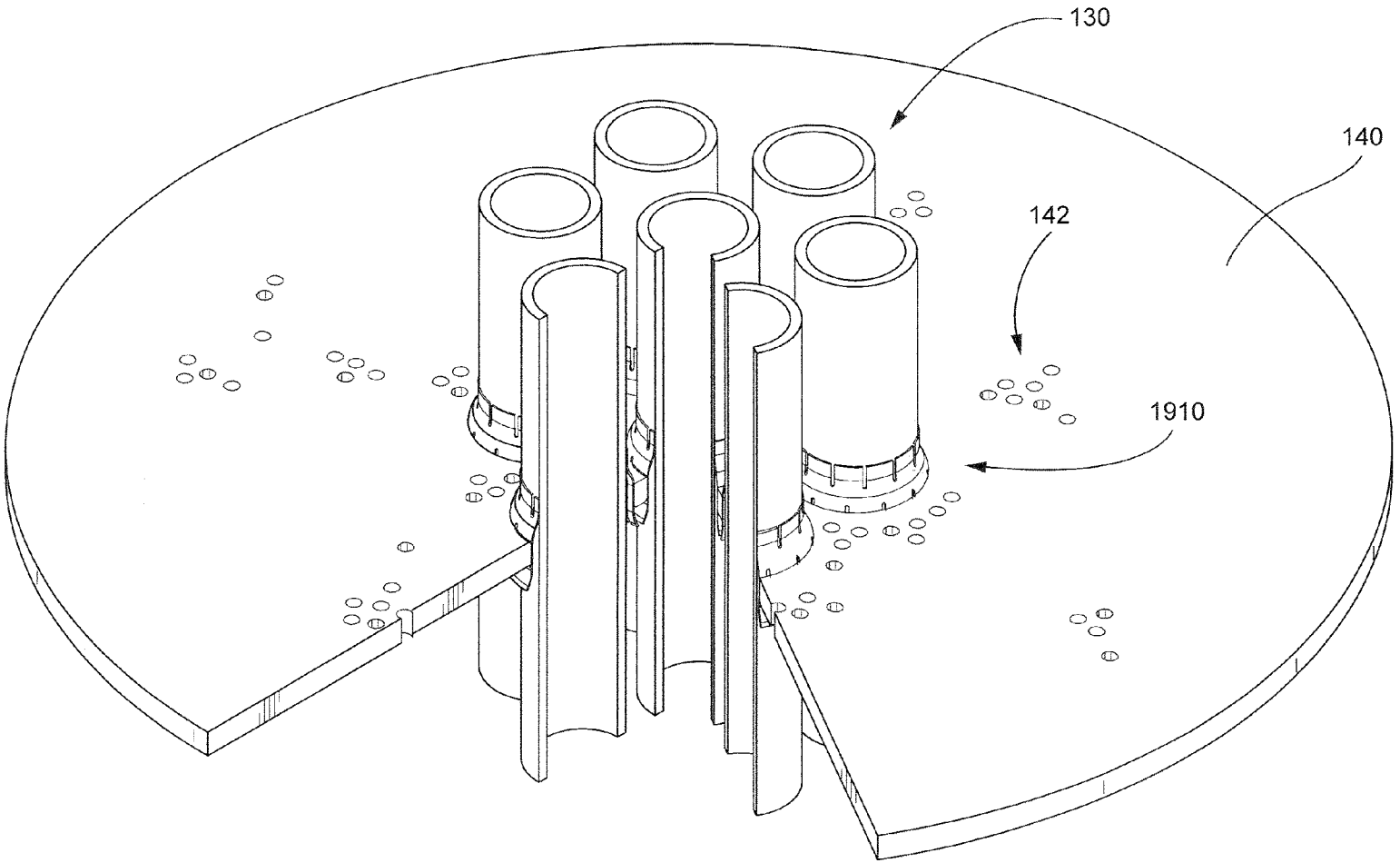
FIG. 21 is a perspective view of a perforated plate assembly including the thimbles of FIGS. 19 and 20.
Figure 22:
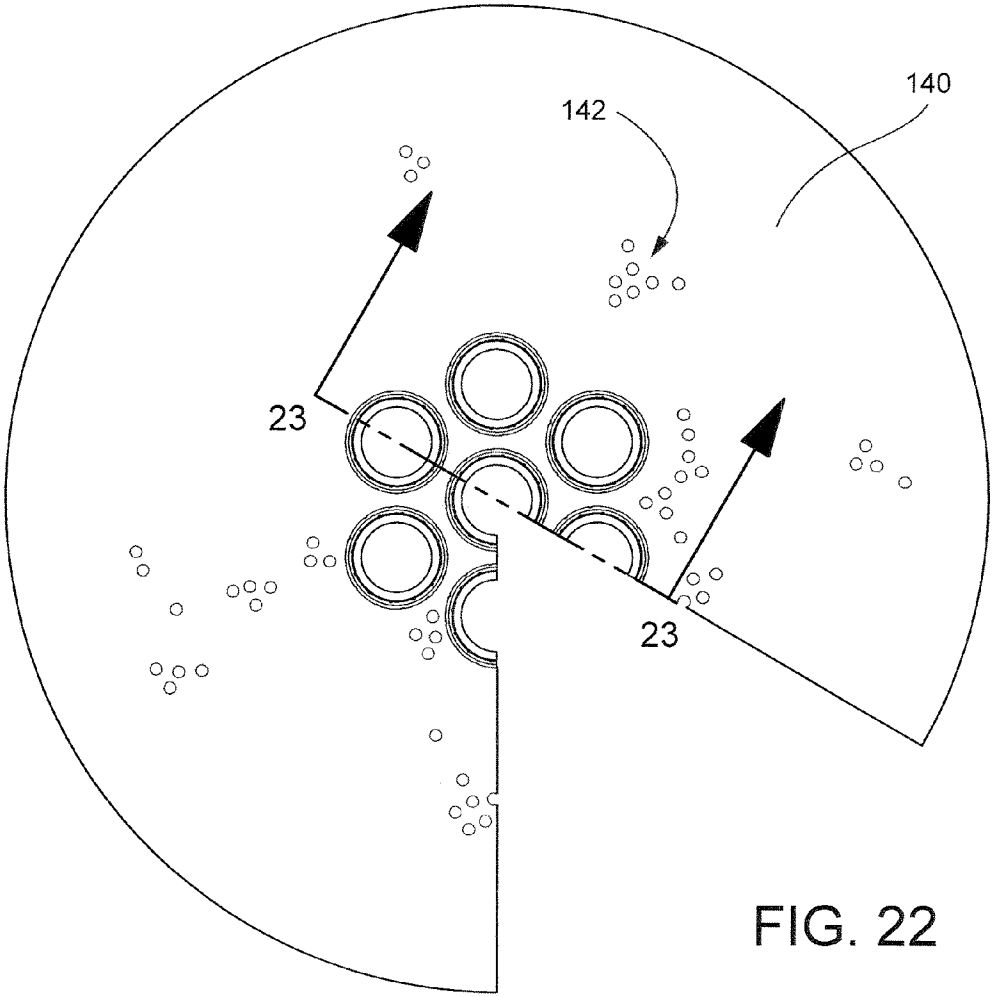
FIG. 22 is a top view of the perforated plate assembly of FIG. 21.
Figure 23:
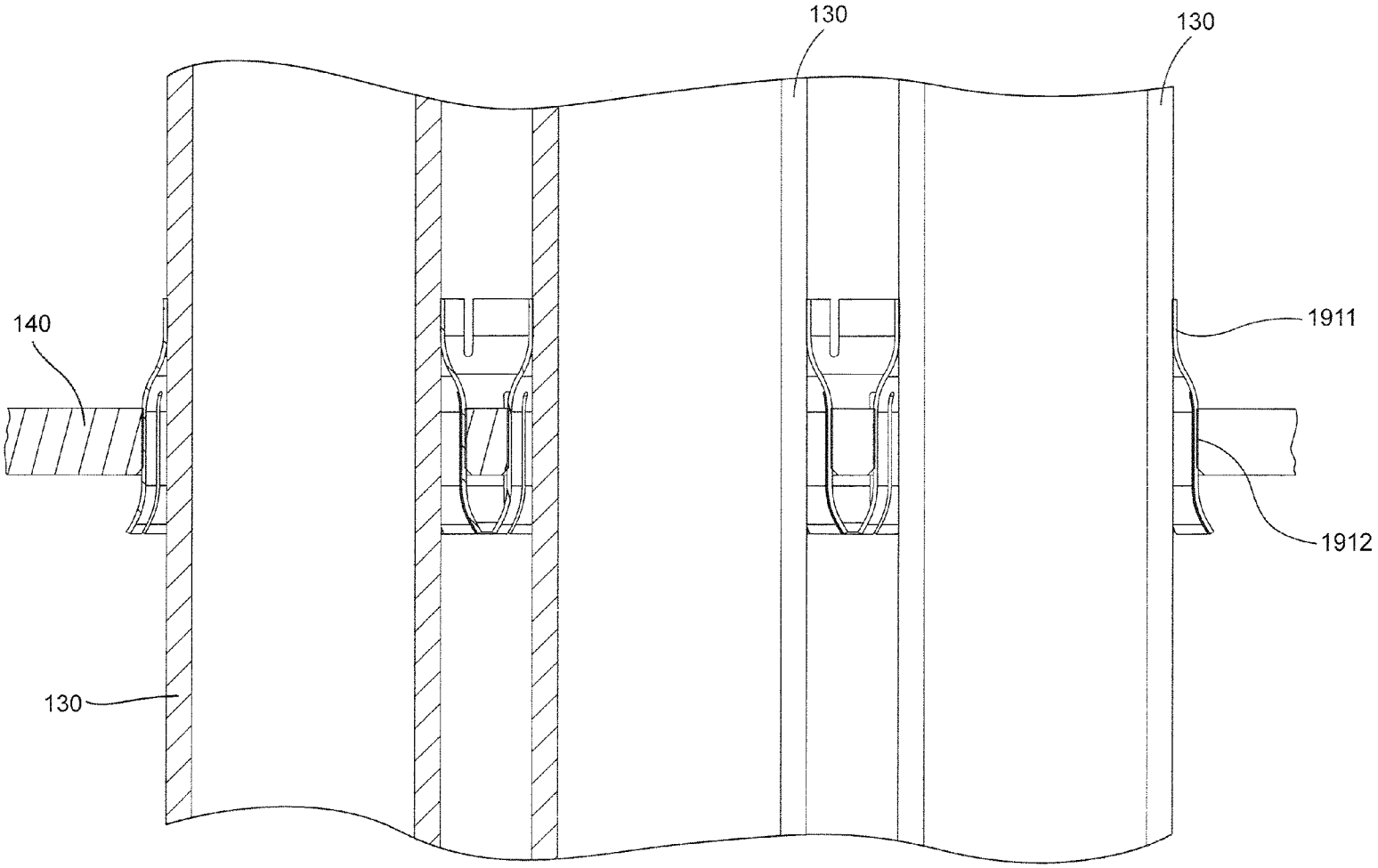
FIG. 23 is a cross-sectional view along the line 23-23 of FIG. 22.

The fingers 912 effectively reduce the size of the annulus areas such that the spaces 914 form a plurality of channels 916 through which the circuit airflow 120 is allowed to pass through the annulus areas 146, as shown in FIG. 10. As a width of the fingers 912 increases, the channels 916 become smaller which causes a larger portion of the circuit airflow 120 to be distributed to the impingement holes 142. The distribution of the circuit airflow 120 between the impingement holes 142 and the annulus areas 146 may be fine tuned to maximize cooling efficiency. The fingers 912 are also flexible which enables dampening of vibrations and accommodation of movement and misalignment of the mixing tubes 130. The respective sizes of the fingers 912 and the spaces 914 may also be adjusted to affect the stiffness of the fingers 912 to achieve a desired level of dampening and/or support.

Turning to FIGS. 14-18, a two-ply metering plate 1400 is shown in accordance with another example of the disclosed technology. The two-ply metering plate 1400 includes a plurality of through holes 1402 corresponding to the impingement holes 142 of the perforated plate 140. In contrast to the metering plate 900 described above, the two-ply metering plate 1400 includes a top metering plate 1420 and a bottom metering plate 1430 attached to the top metering plate. The top metering plate 1420 has a plurality of first fingers 1422 separated by first spaces 1424, while the bottom metering plate 1430 has a plurality of second fingers 1432 separated by second spaces 1434. The first fingers 1422, first spaces 1424, second fingers 1432, and second spaces 1434 effectively form a series of metering elements 1410.

The first spaces 1424 and the second spaces 1434 together form a plurality of channels 1440 through which the circuit airflow 120 is allowed to pass through the annulus areas 146. The first and second spaces 1424, 1434 may be aligned or offset as desired to affect distribution of the circuit airflow 120 between the impingement holes 142 and the annulus areas 146.

The two-ply nature of the first and second fingers 1422, 1432 may combine to provide a stiffer component (first and second fingers together) which may aid in achieving a desired level of dampening and/or support. Additionally, the first and second fingers 1422, 1432 may be aligned or offset as desired to affect stiffness.

In FIGS. 19-23, a plurality of thimbles 1910 is shown in accordance with another example of the disclosed technology. The thimbles may be individually attached to and removed from the mixing tubes 130. Accordingly, a damaged thimble may be individually removed and replaced which may reduce repair costs.

The thimbles include a plurality of fingers 1925 separated by spaces 1924. The spaces 1924 form a plurality of channels 1916, shown in FIG. 20, which allow the circuit airflow 120 to pass through the annulus areas 146. The size of the fingers 1925 and the spaces 1924 may be adjusted to affect metering and dampening in the same manner as the fingers and spaces described above in the previous embodiments.

A plate engaging section 1912 extends circumferentially around a middle portion of the thimbles 1910 for engaging the perforated plate 140. The plate engaging section 1912 may be snap fit, interference fit, or otherwise attached to the perforated plate 140. In addition to providing channels 1916 for the circuit airflow 120, the spaces 1924 may also allow the plate engaging section 1912 to flex to accommodate the perforated plate 140. The mixing tubes 130 may then be inserted into the thimbles 1910. The thimbles further include a plurality of tube engaging portions 1911 separated by slits 1921. The tube engaging portions 1911 are configured to receive the mixing tubes 130 by interference fit. The slits 1921 may allow the tube engaging portions 1911 to flex so as to accommodate misalignment of the mixing tubes 130.

Alternatively, it is noted that the thimbles 1910 may first be attached to the mixing tubes 130 and then connected to the perforated plate 140.

Figure 24:
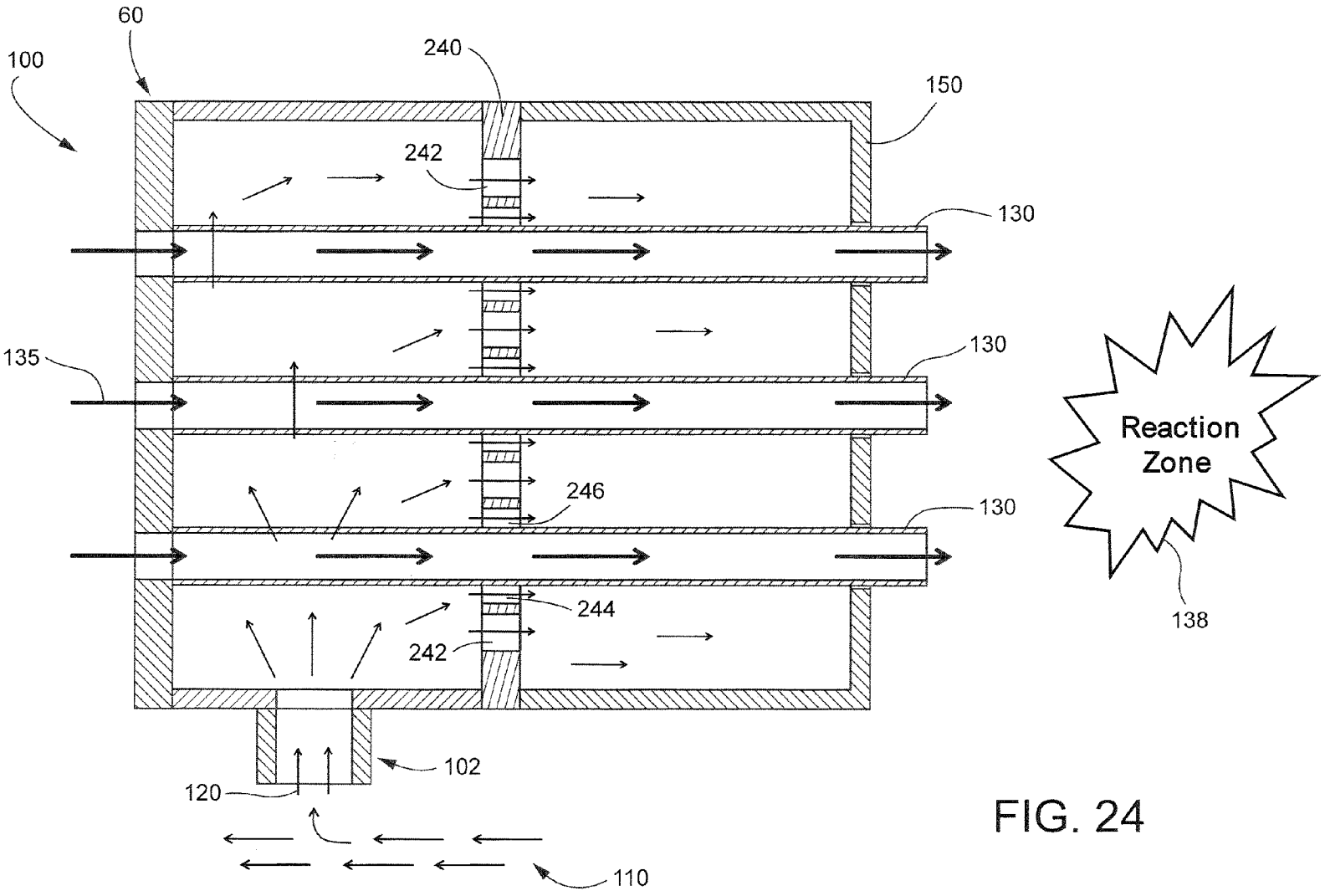
FIG. 24 shows a schematic representation of a combustor cooling circuit including a distribution plate in a gas turbine according to another example of the disclosed technology.

According to another example of the disclosed technology shown in FIG. 24, the sealing plate 400, the metering plates 900, 1400 and the plurality of thimbles 1910 may be attached to or otherwise used with a distribution plate 240 in the same manner described above with reference to the perforated plate 140.

The distribution plate 240 is used to control the amount of air fed to a downstream cooling circuit. The distribution plate 240 includes a plurality of tube holes 244 for accommodating the mixing tubes 130 and a plurality of distribution holes 242 for passing air through the distribution plate 240. The distribution holes 242 are typically sized to allow for a drop in pressure across the distribution plate to balance the air distribution in the upstream area. The size of the distribution holes 242 also affects the amount of air delivered to the downstream region where it is used for cooling.

The tube holes 244 and the mixing tubes 130 form annulus areas 246 between the distribution plate 240 and the mixing tubes.

The sealing plate 400, the metering plates 900, 1400 and the plurality of thimbles 1910 may be used with the distribution plate 240 to control air flow through the distribution plate in the same manner described above with reference to the perforated plate 140.

Figure 25:
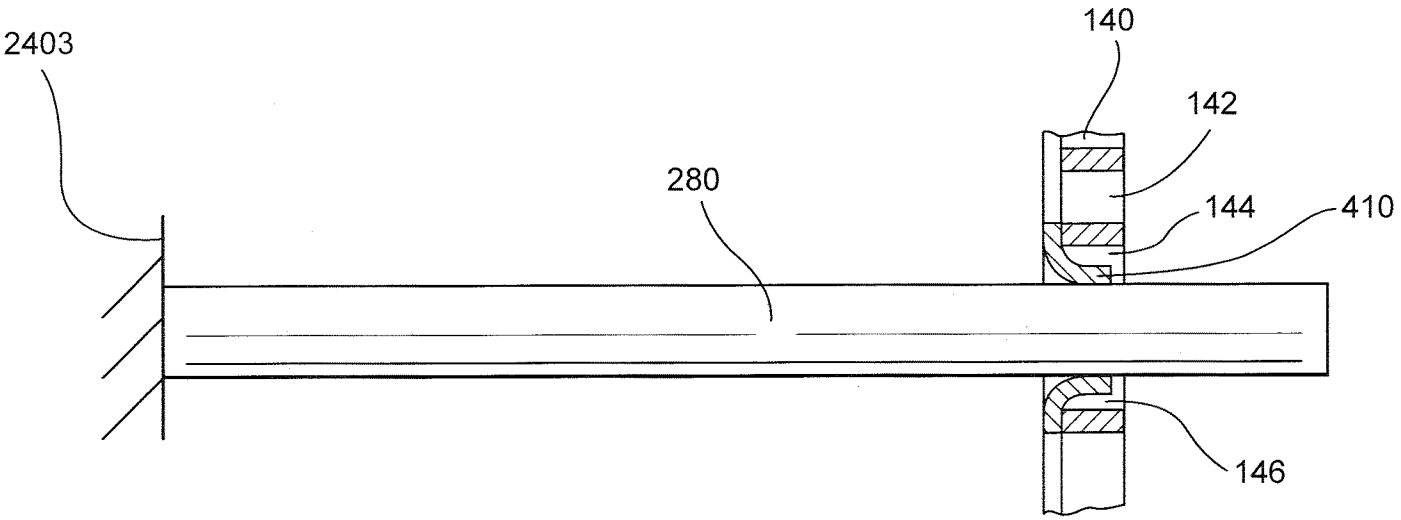
FIG. 25 is a side view of a cantilevered mixing tube and perforated plate assembly according to a fifth example of the disclosed technology.

FIG. 25 illustrates a cantilevered mixing tube 280 attached at one end to a frame member 2403. Frictional dampening by the sealing elements 410 may reduce fatigue to a mounting joint at the frame member 2403. It is noted that the sealing elements 410 are merely shown as an example and that any of the other embodiments described as providing dampening may also be used.

While the invention has been described in connection with what is presently considered to be the most practical and preferred examples, it is to be understood that the invention is not to be limited to the disclosed examples, but on the contrary, is intended to cover various modifications and equivalent arrangements included within the spirit and scope of the appended claims.

What is claimed is:

1. A was turbine combustor, comprising:

a plurality of mixing tubes arranged to transport at least one of fuel and air to a reaction zone for ignition;

a plate having a plurality of through-holes and a plurality of tube holes formed therein, the tube holes being configured to accommodate the mixing tubes thereby forming a plurality of annulus areas between the plate and the mixing tubes, the through-holes and the annulus areas being configured, respectively, to pass an airflow through the plate to a common area immediately adjacent the plate where the airflow passing through the through-holes and the air flow passing through the annulus areas intermix; and a flow management device having a first portion directly attached to the plate and a plurality of second portions extending into the annulus areas formed between the plate and the mixing tubes to control a distribution of the airflow through the through-holes and the annulus areas of the plate, wherein the plurality of second portions of the flow management device respectively engages the plurality of mixing tubes.

2. The gas turbine combustor of claim 1, further comprising a hot plate separating the reaction zone and the plate, wherein the airflow cools the hot plate.

3. The gas turbine combustor of claim 1, wherein the flow management device includes a plurality of metering elements for controlling a flow rate of the airflow through the annulus areas.

4. The gas turbine combustor of claim 3, wherein the metering elements include a plurality of fingers and a plurality of spaces separating the fingers, the fingers and spaces forming a plurality of channels for conveying the airflow.

5. The gas turbine combustor of claim 4, wherein the size of the fingers and/or the size of the spaces is modified to control the distribution of the airflow through the through-holes and the annulus areas of the plate.

6. The gas turbine combustor of claim 4, wherein the plurality of fingers includes a plurality of overlapping fingers.

7. The gas turbine combustor of claim 4, wherein the metering elements include a plurality of discrete thimbles.

8. The gas turbine combustor of claim 4, wherein the plate is a perforated plate and the through-holes are impingement holes.

9. A method of controlling airflow through a plate in a gas turbine, the plate including a plurality of through-holes and a plurality of tube holes formed therein, the tube holes being adapted to accommodate a plurality of mixing tubes with which the tube holes form a plurality of annulus areas between the plate and the mixing tithes, the method comprising:

establishing an airflow adapted to pass, respectively, through the through-holes and the annulus areas to a common area immediately adjacent the plate where the airflow passing through the through-holes and the airflow passing through the annulus areas intermix; and providing a flow management device to adjust an effective size of the annulus areas, the flow management device having a first portion directly attached to the plate and a plurality of second portions extending into the annulus areas formed between the plate and the mixing tubes to control a distribution of the airflow through the through-holes and the annulus areas of the plate, wherein the plurality of second portions of the flow management device respectively engages the plurality of mixing tubes.

10. The method of claim 9, further comprising a hot plate adapted to separate the plate from the reaction zone of the gas turbine, wherein the airflow cools the hot plate, and an efficiency of the cooling is controlled by the adjustment of the effective size of the annulus areas.

11. The method of claim 9, wherein the flow management device includes a plurality of fingers and a plurality of spaces separating the fingers, the fingers and spaces forming a plurality of channels for conveying the airflow.

12. The method of claim 11, wherein the size of the fingers and/or the size of the spaces is modified to adjust the effective size of the annulus areas.

13. The method of claim 11, wherein the plate is a distribution plate and the through-holes are distribution holes.

14. A cooling air circuit positioned near a reaction zone in a gas turbine, comprising:

an inlet through which an airflow enters a section of the gas turbine;

a plate situated in the section and including a plurality of holes formed therein to pass the airflow through the plate to a common area immediately adjacent the plate where the airflow passing through each of the plurality of holes can intermix;

a plurality of mixing tubes extending through a first portion of the plurality of holes to transport at least one of fuel and air to the reaction zone for ignition, the first portion of holes forming a plurality of annulus areas between the plate and the mixing tubes;

a flow management device having a first portion directly attached to the plate and a plurality of second portions extending into the annulus areas formed between the plate and the mixing tubes to control a flow rate of the airflow through the first portion of holes, wherein the plurality of second portions of the flow management device respectively engages the plurality of mixing tubes.

15. The cooling circuit of claim 14, further comprising a hot plate separating the reaction zone and the plate, wherein the airflow cools the hot plate, and an efficiency of the cooling is controlled by the flow rate of the airflow through the first portion of the holes.

16. The cooling circuit of claim 14, wherein the flow management device includes a plurality of metering elements for controlling the flow rate of the airflow through the first portion of the holes.

17. The cooling circuit of claim 16, wherein the metering elements include a plurality of fingers and a plurality of spaces separating the fingers, the fingers and spaces forming a plurality of channels for conveying the airflow.

18. The cooling circuit of claim 17, wherein the size of the fingers and/or the size of the spaces is modified to control the flow rate of the airflow through the first portion of the holes.

19. The cooling circuit of claim 17, wherein the fingers dampen vibration of the mixing tubes.

20. The cooling circuit of claim 17, wherein the plate is a perforated plate.

21. The gas turbine combustor of claim 1, wherein the plate is configured such that each of the airflow passing through the through-holes and the airflow passing through the annulus areas emerges from the plate in the common area, and wherein the first portion of the flow management device comprises a plate member attached to an upstream side of the plate, and wherein the plurality of second portions of the flow management device form a plurality of holes in the flow management device which correspond to the plurality of tube holes such that the plurality of holes is configured to receive the mixing tubes.

22. The method of claim 9, further comprising passing the airflow through the plate such that each of the airflow passing, through the through-holes and the airflow passing through the annulus areas emerges from the plate in the common area, and wherein the first portion of the flow management device comprises a plate member attached to an upstream side of the plate, and wherein the plurality of second portions of the flow management device form a plurality of holes in the flow management device which correspond to the plurality of tube holes such that the plurality of holes is configured to receive the mixing tubes.

23. The cooling circuit of claim 14, wherein the plate is configured such that the airflow passing through each of the plurality of holes emerges from the plate in the common area, and wherein the first portion of the flow management device comprises a plate member attached to an upstream side of the plate, and wherein the plurality of second portions of the flow management device form a plurality of holes in the flow management device which correspond to the plurality of tube holes such that the plurality of holes is configured to receive the mixing tubes.

* * * * *

UNITED STATES PATENT AND TRADEMARK OFFICE

CERTIFICATE OF CORRECTION

PATENT NO. : 9,285,121 B2
APPLICATION NO. : 13/593123
DATED : March 15, 2016
INVENTOR(S) : Keener et al.

It is certified that error appears in the above-identified patent and that said Letters Patent is hereby corrected as shown below:

In the Claims:

Claim 1, column 6, line 40, change “was turbine combustor” to --gas turbine combustor--

Claim 1, column 6, line 51, change “air flow” to --airflow--

Claim 9, column 7, line 21, change “mixing tithes” to --mixing tubes--

Claim 22, column 8, line 43, change “passing,” to --passing--

Signed and Sealed this
Tenth Day of May, 2016

Michelle K. Lee

Michelle K. Lee
*Director of the United States Patent and Trademark Office*